US006492630B2

(12) United States Patent
Nagahira

(10) Patent No.: US 6,492,630 B2
(45) Date of Patent: Dec. 10, 2002

(54) INDUCTION HEATING APPARATUS FOR HEATING IMAGE FORMED ON RECORDING MATERIAL

(75) Inventor: Joji Nagahira, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/077,942

(22) Filed: Feb. 20, 2002

(65) Prior Publication Data

US 2002/0148828 A1 Oct. 17, 2002

(30) Foreign Application Priority Data

Feb. 23, 2001 (JP) ..... 2001-048684
Feb. 13, 2002 (JP) ..... 2002-035282

(51) Int. Cl.[7] ..... H05B 6/14; H05B 6/08; G03G 15/20

(52) U.S. Cl. ..... 219/619; 219/663; 219/667; 399/330; 399/336

(58) Field of Search ..... 219/619, 661, 219/663, 665, 667, 666; 399/330, 331, 335, 328, 336, 329

(56) References Cited

U.S. PATENT DOCUMENTS 4,482,243 A 11/1984 Suzuki et al. ..... 355/14 D
5,767,484 A * 6/1998 Hirabayashi et al. ..... 399/329
6,037,576 A * 3/2000 Okabayashi et al. ..... 219/619
6,087,641 A * 7/2000 Kinouchi et al. ..... 219/619
6,292,647 B1 * 9/2001 Ishida ..... 399/330

FOREIGN PATENT DOCUMENTS

JP 10-31389 2/1998
JP 10-74009 3/1998
JP 2000-66543 3/2000

* cited by examiner

*Primary Examiner*—Philip H. Leung
(74) *Attorney, Agent, or Firm*—Fitzpatrick, Cella, Harper & Scinto

(57) ABSTRACT

An induction heating apparatus for heating an image formed on a recording material that has heating device for heating the image on the recording material, the heating device including a heating member and an excitation coil for generating a magnetic flux to induce an eddy current in the heating member, an input impedance of the heating device being variable, a temperature detecting element for detecting a temperature of the heating member, and control device for controlling a frequency of an electrical supply to the excitation coil so that the temperature detected by the temperature detecting element is maintained at a set temperature. In the induction heating apparatus, the control device controls the frequency in accordance with the temperature detected by the temperature detecting element and information regarding the input impedance of the heating device.

9 Claims, 26 Drawing Sheets

PROCESSING a DURING PRINTING

STANDBY SETTING PROCESS a

STANDBY SETTING PROCESS b

PROCESSING b DURING PRINTING

INDUCTION HEATING APPARATUS FOR HEATING IMAGE FORMED ON RECORDING MATERIAL

BACKGROUND OF THE INVENTION

1. Field of the Invention

This invention relates to an image heating apparatus such as a heating and fixing apparatus mounted on a copier or a printer, or an apparatus for improving the surface state of an image, and particularly to an image heating apparatus for generating heat by the use of the principle of electromagnetic induction.

2. Related Art

For example, in image forming apparatuses such as printers, copiers and facsimile apparatuses adopting the image forming process of the electrophotographic type, the electrostatic recording type or the like, there are known and have been put into practical use heating apparatuses of various types based on various principles for heat-fixing an unfixed toner image of desired image information formed and borne on a recording material (such as a transferring material, printing paper, photosensitive paper or electrostatic recording paper) by a transferring process or a direct method in an image forming process portion as a fixed image.

Various types have also been proposed in the heating apparatuses of the electromagnetic. induction heating type as described above to which the present invention is directed.

For example, in Japanese Patent Application Laid-Open No. 10-31389, there is proposed an induction heating and fixing apparatus comprised of a fixing roller, a core passing through the interior of the fixing roller for forming a closed magnetic circuit, first and second coils wound on the core and series-connected together, and a power supply circuit for supplying an alternating current to the first and second coils, and having a control device for switching the circuit so as to supply the alternating current from the power supply circuit to both of the first and second coils for a predetermined time from the start of the temperature rise of the fixing roller, and to supply the alternating current onto to the first coil from after the lapse of the predetermined time, and designed to suppress the current flowing to the coils at the early stage of the temperature rise, and prevent the temperature rise speed from becoming low to the utmost.

Also, in Japanese Patent Application Laid-Open No. 2000-66543, there is proposed an induction heating and fixing apparatus comprised of a heating roller in which an induction heating coil comprising a lead wire wound on a winding frame is disposed, a movable core and two coils, wherein the movement of the core or a current supplied to the coils is limited in conformity with the temperature of the axial end portions of the heating roller, and a magnetic flux passing through the end portions is varied to thereby eliminate the unevenness of the temperature of the surface of the fixing roller in the axial direction thereof resulting from the fixing operation.

Also, in Japanese Patent Application Laid-Open No. 10-74009, there is disposed a fixing apparatus of the induction heating type in which magnetic flux intercepting means for intercepting part of a magnetic flux reaching a metal sleeve from an excitation coil is disposed between the metal sleeve and the excitation coil, and the position of the magnetic flux intercepting means is changed by displacing means in conformity with a sheet passing range in the metal sleeve, whereby the heat distribution of the metal sleeve rising in temperature is made controllable irrespective of the size of a recording material passed.

The image heating apparatuses as described above are for fixing a toner image on a recording material, and highly accurate temperature control is required of them so that the fixativeness of the toner may become optimum. Therefore, it is necessary to effect temperature control so that the temperature of the metal sleeve contacting with the toner image may not greatly deviate from a target temperature.

In the three publications mentioned above, it is described to switch the supply of electric power to the two coils or move the core as required.

Such an operation, however, results in a fluctuation in the input impedance of the coils.

When the input impedance changes, the electric power supplied to the coils fluctuates and therefore, even if for example, the supply of electric power to the coils is controlled so that the temperature detected by a temperature sensor for detecting the temperature of the metal sleeve may maintain a set temperature, desired electric power supply is not obtained and therefore, the temperature rise of the metal sleeve is delayed and the ripple of the temperature of the metal sleeve becomes great.

The fluctuation of the input impedance also depends on the temperature of the heating apparatus. That is, the fluctuation of the electric power supplied to the coils also depends on the temperature of the heating apparatus.

As described above, the input impedance is fluctuated by a change in the farm or temperature of the heating apparatus and the electric power supplied to the coils is not stable, and the ripple of the temperature of the metal sleeve becomes great. Consequently, the fixativeness of the toner is affected.

SUMMARY OF THE INVENTION

The present invention has been made in view of the above-noted problem and an object thereof is to provide an induction heating apparatus in which the ripple of the temperature of a heating member can be made small.

Another object of the present invention is to provide an induction heating apparatus in which optimum electric power supply can be effected even if the input impedance of the heating apparatus changes.

Still another object of the present invention is to provide an induction heating apparatus comprising:

- heating means for heating an image on a recording material, the heating means including a heating member and an excitation coil for generating a magnetic flux to induce an eddy current in the heating member;
- an input impedance of the heating means being variable;
- a temperature detecting element for detecting a temperature of the heating member; and
- control means for controlling a frequency of electrical supply to the excitation coil so that the temperature detected by the temperature detecting element is maintained at a set temperature;
- wherein the control means controls the frequency in accordance with the temperature detected by the temperature detecting element and information regarding the input impedance of the heating means.

Further objects of the present invention will become apparent from the following detailed description when read with reference to the accompanying drawings.

DESCRIPTION OF THE PREFERRED EMBODIMENTS

Embodiment 1 (FIGS. 1 to 5, 6A to 6F)

(1) Example of an Image Forming Apparatus

Figure 1:
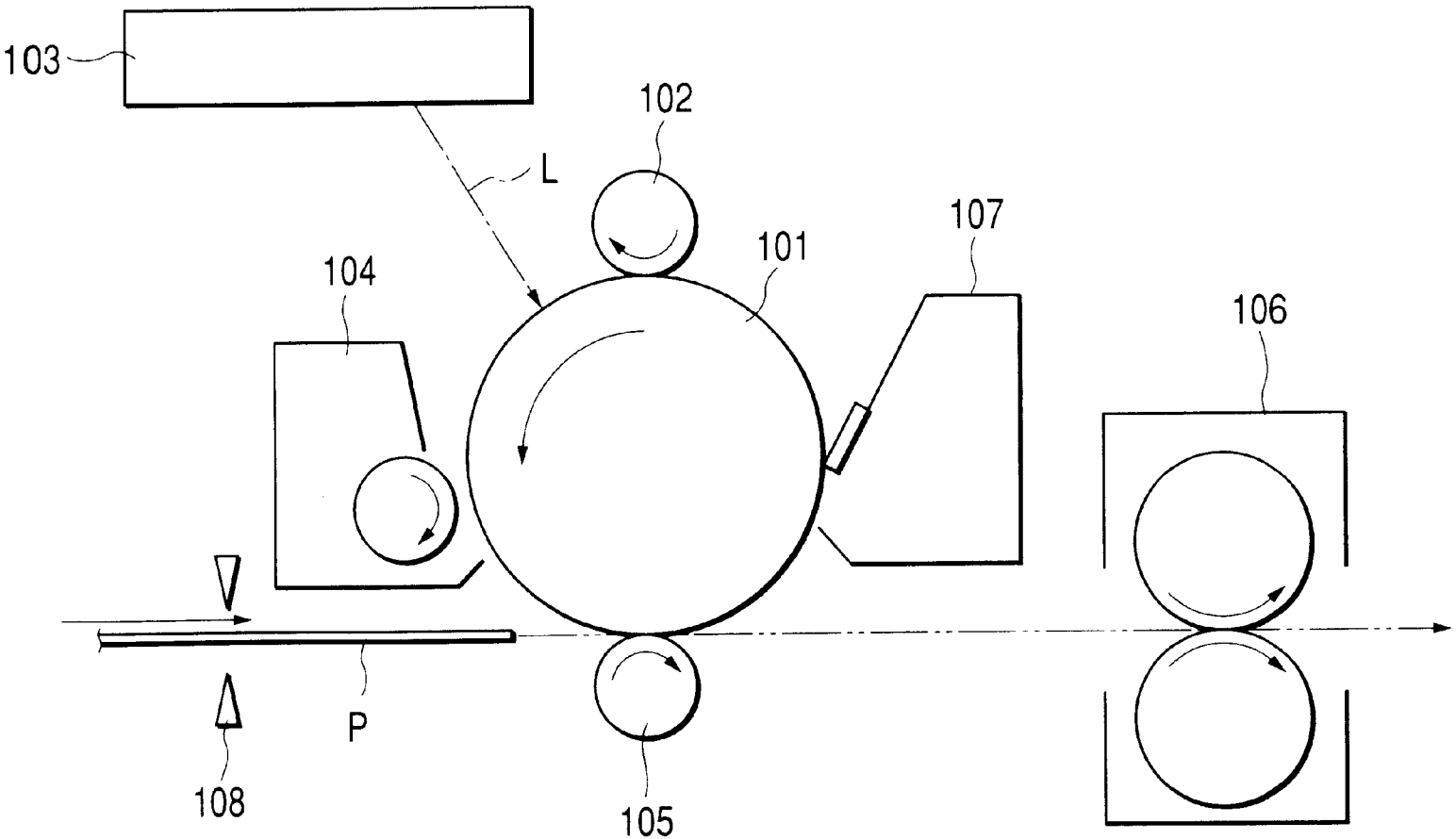
FIG. 1 is a schematic cross-sectional view of a printer provided with the induction heating apparatus of the present invention.

FIG. 1 schematically shows the construction of an example of an image forming apparatus. This image forming apparatus is a laser beam printer utilizing the transfer type electrophotographic process.

The reference numeral 101 designates a photosensitive drum as an image bearing member comprising a cylinder-shaped base of aluminum, nickel or the like and a photosensitive material such as OPC, amorphous Se or amorphous Si formed thereon.

The photosensitive drum 101 is rotatively driven at a predetermined peripheral speed in the clockwise direction of arrow, and the surface thereof is first uniformly charged to a predetermined polarity and predetermined potential by a charging roller 102 as a charging apparatus.

Next, scanning exposure L by a laser beam ON/OFF-controlled in conformity with image information is effected on the uniformly charged surface of the photosensitive drum by a laser scanner 103, whereby an electrostatic latent image is formed.

This electrostatic latent image is developed and visualized as a toner image by a developing apparatus 104. As the developing method, use is made of a jumping developing method, a two-component developing method, an FEED developing method or the like, and image exposure and reversal developing are often used in combination with each other.

The visualized toner image is transferred from the photosensitive drum 101 onto a recording material P conveyed at predetermined timing, by a transferring roller 105 as a transferring apparatus.

Here, the leading edge of the recording material P is detected and timed by a sensor 108 so that the image forming position of the toner image on the photosensitive drum 101 and the writing start position on the leading edge of the recording material P may coincide with each other. The recording material P conveyed at the predetermined timing is nipped and conveyed by and between the photosensitive drum 101 and the transferring roller 105 with a constant pressure force.

The recording material P to which the toner image has been transferred is conveyed to a heating and fixing apparatus (fixing device) 106, where the toner image is heated and fixed as a permanent image.

On the other hand, any untransferred toner residual on the photosensitive drum 101 is removed from the surface of the photosensitive drum 101 by a cleaning apparatus 107.

(2) Heating and Fixing Apparatus 106

Figure 2:
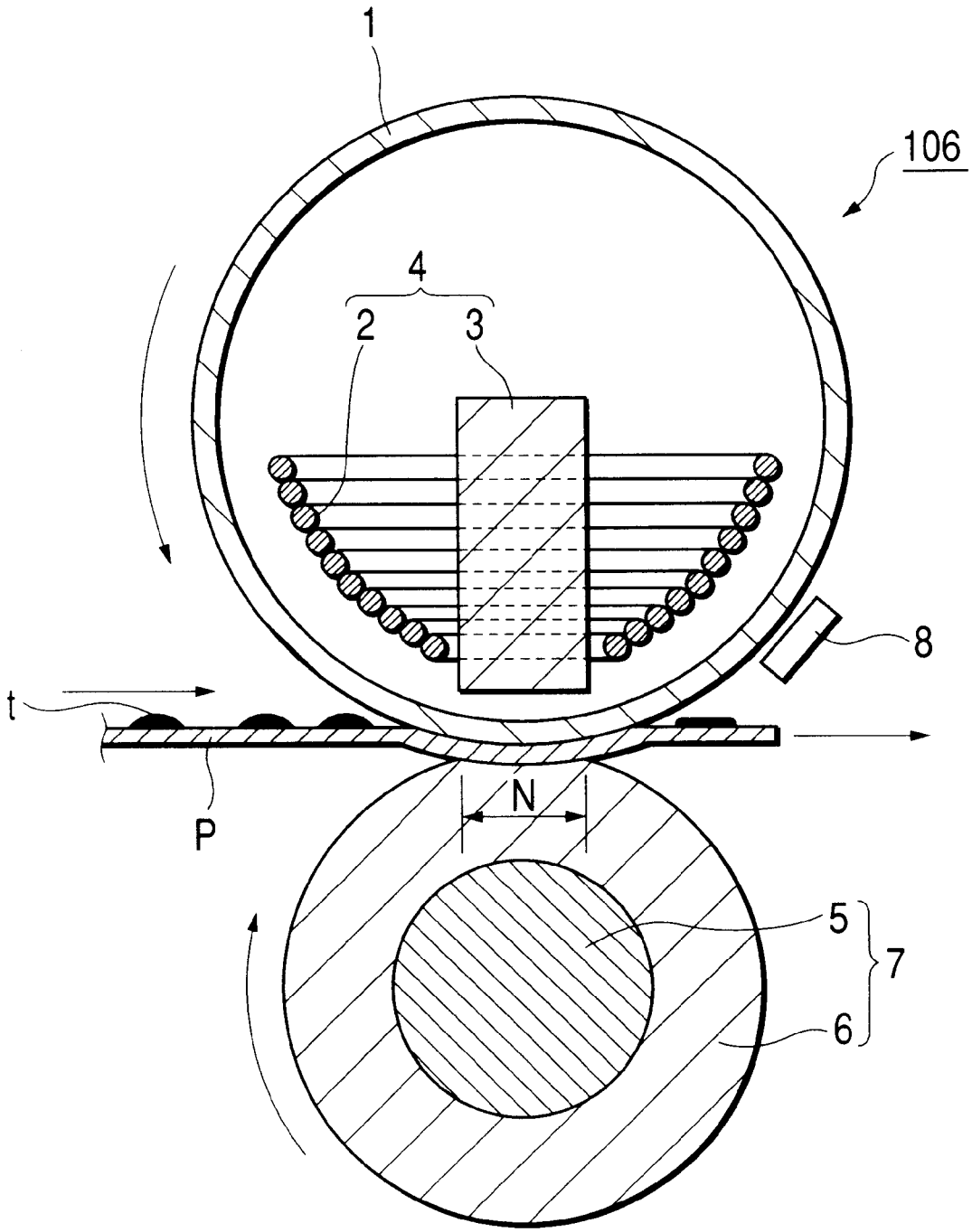
FIG. 2 is a cross-sectional view of an induction heating apparatus according to Embodiment 1.
Figure 3:
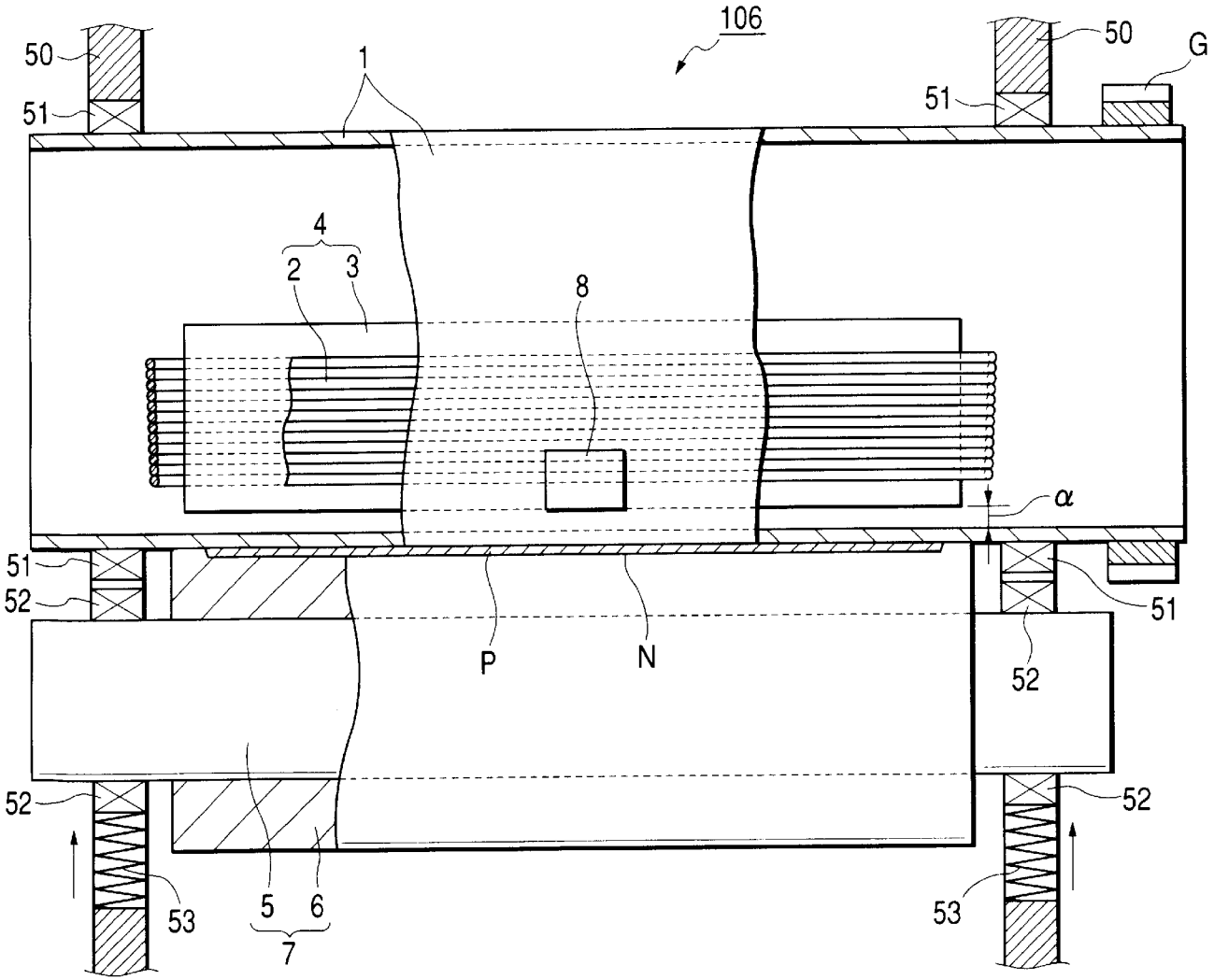
FIG. 3 is a partly cut-away side view of the induction heating apparatus of FIG. 2 as it is seen from a recording material discharging side.
Figure 4:
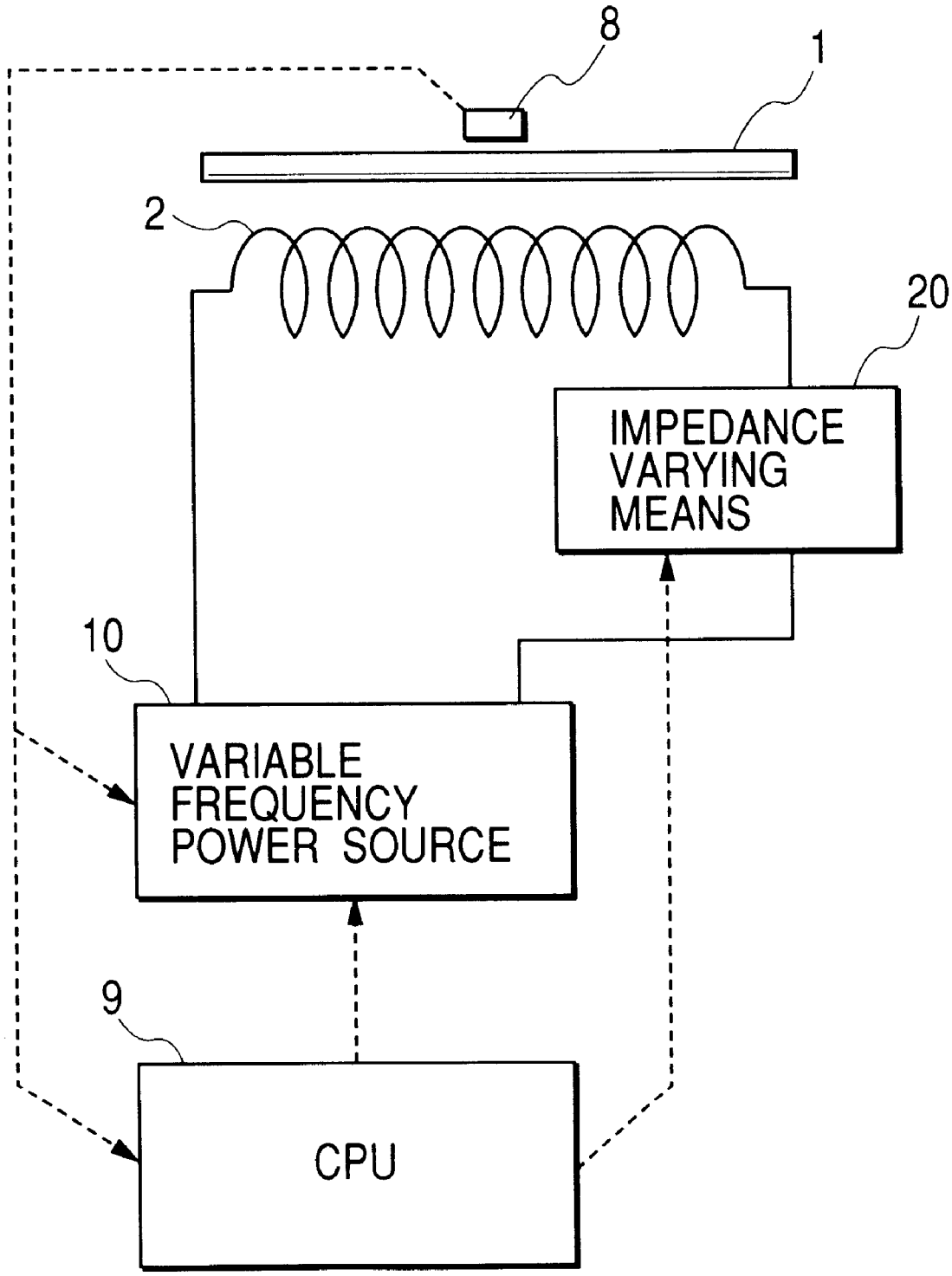
FIG. 4 is a model view of the essential portions of the induction heating apparatus of FIG. 2.

The heating and fixing apparatus 106 in this Embodiment 1 is a heat roller type electromagnetic induction heating apparatus. FIG. 2 is an enlarged transverse cross-sectional model view of this apparatus 106, and FIG. 3 is a partly cut-away rear model view thereof (the recording material exit side). FIG. 4 is a construction diagram (block diagram).

The reference numeral 1 denotes a cylindrical roller (a heating rotary member induction-heated, hereinafter referred to as the fixing roller) made of a magnetic metal as an electromagnetic induction heat generating member. This fixing roller 1 has its opposite end portions rotatably mounted between the chassis side plates 50 on this side and the inner side of the apparatus through bearings 51.

The reference numeral 7 designates a pressure roller comprised of a mandrel 5 and a heat-resistant and elastic material layer 6 of silicone rubber, fluorine rubber, fluorine resin or the like formed on and covering the mandrel concentrically and integrally therewith. This pressure roller 7 is disposed under and in parallel to the fixing roller 1, and has the opposite end portions of its mandrel 5 rotatably held between the chassis side plates 50 on this side and the inner side of the apparatus through bearings 52, and is disposed with the bearings 52 upwardly biased by biasing means (biasing springs) 53 to thereby bring the heat-resistant and elastic material layer 6 of the pressure roller 7 into pressure contact with the underside of the fixing roller 1 with a predetermined pressure force. By the pressure contact of this pressure roller 7 with the fixing roller 1, the heat-resistant and elastic material layer 6 of the pressure roller 7 is deformed against elasticity in the pressure contact portion thereof with the fixing roller 1 whereby a fixing nip part N of a predetermined width as a heated material heating portion is formed between the pressure roller 7 and the fixing roller 1.

The reference numeral 4 denotes a magnetic field generating means assembly inserted and disposed inside the fixing roller 1, and it is a laterally long assembly long in the lengthwise direction of the fixing roller 1. The magnetic field generating means assembly 4 has an excitation coil 2 and a magnetic core (excitation core) 3 having an I-shaped transverse crosssection. The excitation coil 2 is formed by a copper wire being wound a plurality of times in one direction, and the magnetic core 3 is disposed so as to be orthogonal to the copper wire of the excitation coil 2 and forms a magnetic circuit. The magnetic core 3 is formed of a magnetic material, and comprises, for example, a ferrite core or a laminated core.

The magnetic field generating means assembly 4 inserted and disposed in the fixing roller 1 is unrotatably supported with its opposite end portions fixed to the immovable member of the apparatus through a holder, not shown, and is disposed in non-contact with the inner peripheral surface of the fixing roller 1 with a predetermined gap a left between it and the inner peripheral surface of the fixing roller 1.

The letter G designates a drive gear fixedly fitted to one end of the fixing roller 1, and by a rotative force being transmitted from a driving system, not shown, to this drive gear G, the fixing roller 1 is rotatively driven at a predetermined peripheral speed in the direction of arrow in FIG. 2. The pressure roller 7 rotates following this rotative driving of the fixing roller 1. The apparatus can also be designed such that this pressure roller 7 is also rotatively driven.

The reference numeral 8 denotes a temperature detecting element (such as a thermistor) for the fixing roller 1, and it is disposed at a location near the recording material exit side of the fixing nip part N and at the substantially lengthwisely central portion of the fixing roller 1 while being held by a support member, not shown, in closely opposed relationship with the fixing roller 1.

In the construction diagram of FIG. 4, the reference numeral 9 designates a CPU (control portion), the reference numeral 10 denotes a variable frequency power source (a variable frequency alternating current power source for supplying an alternating current to the excitation coil), and the reference numeral 20 designates impedance varying means for varying the input impedance of the excitation coil 2.

Thus, the fixing roller 1 is rotatively driven and the pressure roller 7 is also rotated, and a high frequency induction current (eddy current) is induced in the magnetic metal of the fixing roller 1 by an alternating magnetic field generated by a high frequency current being applied from the variable frequency power source 10 to the excitation coil 2 of the magnetic field generating means 4, and the magnetic metal layer of the fixing roller generates electromagnetic induction heat (Joule heat), and in a state in which the fixing roller has risen to a predetermined temperature, the recording material P as a material to the heated is introduced into the fixing nip part N and is nipped and conveyed thereby, whereby the unfixed toner image t is fixed on the recording material P by the heat and nip pressure of the fixing roller 1.

Figure 5:
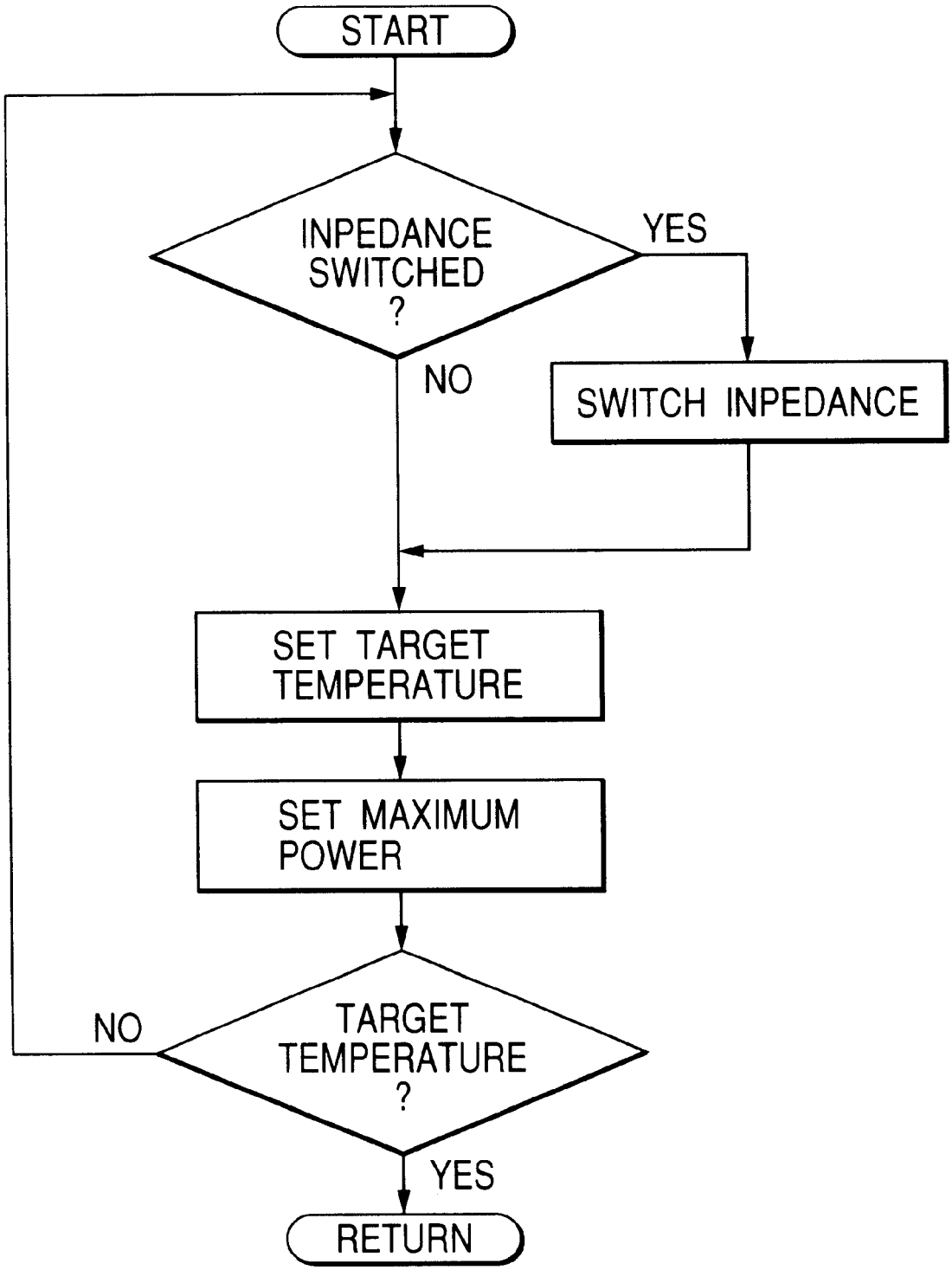
FIG. 5 is a flow chart showing the operation of Embodiment 1.

FIG. 5 is a flow chart showing the operation of a control system. The temperature detecting element 8 such as a thermistor detects the temperature of the fixing roller 1, and the detected temperature information is inputted to the CPU 9 and the variable frequency power source 10. The CPU 9, if it is necessary to switch the input impedance of the excitation coil 2, switches the impedance to the impedance varying means 20. Also, on the basis of the inputted detected temperature information and the sequence state in the present condition, the information of the target temperature of the fixing apparatus and the information of the maximum electrical supply are indicated to the variable frequency power source 10. For example, during the raising of the fixing electric power, in order to raise the fixing apparatus as quickly as possible, the maximum electric power information is set to allowable maximum electric power. When the temperature reaches a standby temperature, the supply of electric power to the coil is thereafter controlled so that the temperature of the fixing roller may maintain the standby temperature. During fixing as well, the supply of electric power to the coil is controlled so as to maintain the target fixing temperature.

The variable frequency power source 10 controls the supply of electric power to the excitation coil 2 so that the temperature of the fixing nip part N may be controlled to a predetermined fixing temperature on the basis of the temperature difference between the detected temperature information and the target temperature information. When the detected temperature information is lower than the target temperature information, the variable frequency power source 10 increases the supplied electric power and raises the temperature of the fixing roller. When the detected temperature information is higher than the target temperature information, the supplied electric power is decreased and the temperature of the fixing roller is lowered. Accordingly, the detected temperature goes toward the target temperature and can be controlled to the target temperature.

Description will now be made of a method of increasing the supplied electric power and decreasing it. FIGS. 6A to 6F show the equivalent circuit and an example of the characteristic of the input impedance of the excitation coil.

Figure 6A:
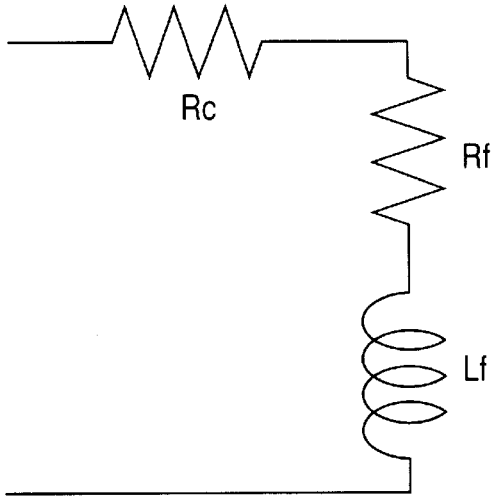
FIG. 6A shows the equivalent circuit of the induction heating apparatus.
Figure 6B:
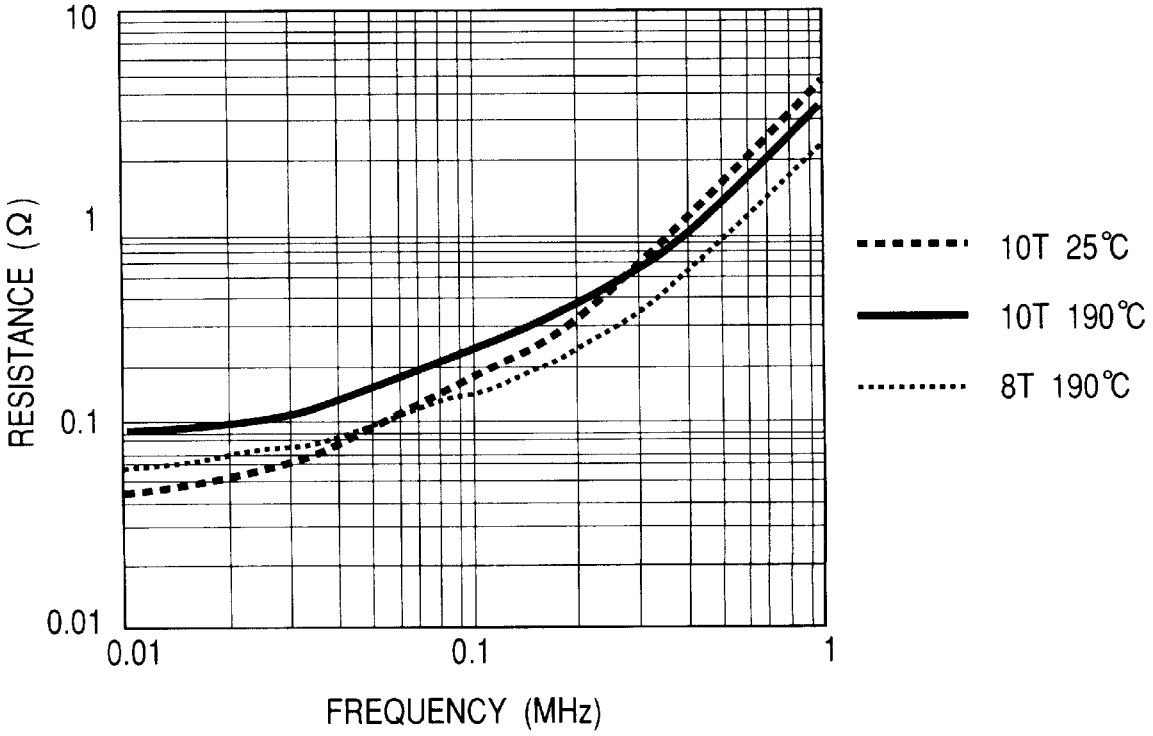
FIG. 6B shows the frequency characteristic of the Rc component of the induction heating apparatus.

FIG. 6A shows an example of the equivalent circuit, in which Rc is a resistance component changed to heat by the magnetic field generating means 4, Rf is a resistance component changed to heat by the fixing roller 1, and Lf is an inductance component. FIG. 6B shows an example of the frequency characteristic of Rc, FIG. 6C shows an example of the frequency characteristic of Rf, and FIG. 6D shows an example of the frequency characteristic of Lf, and these show examples in which the number of turns of the coil is 10 turns and the temperature is 25°, the number of turns of the coil is 10 turns and the temperature is 190°, and the number of turns of the coil is 8 turns and the temperature is 190°.

The supplied electric power W when the input voltage is V is represented by the following expression (1):

$$W(\omega) = \frac{Rc(\omega) + Rf(\omega)}{(Rc(\omega) + Rf(\omega))^2 + (\omega Lf(\omega))^2} V^2 \quad (1)$$

Figure 6C:
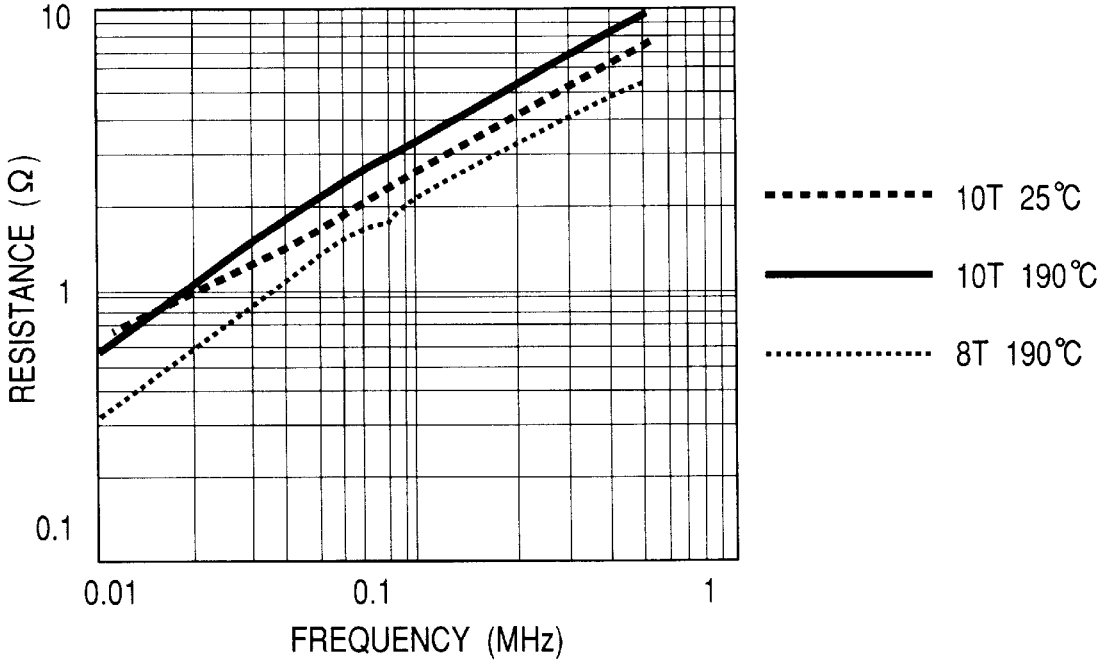
FIG. 6C shows the frequency characteristic of the Rf component of the induction heating apparatus.
Figure 6D:
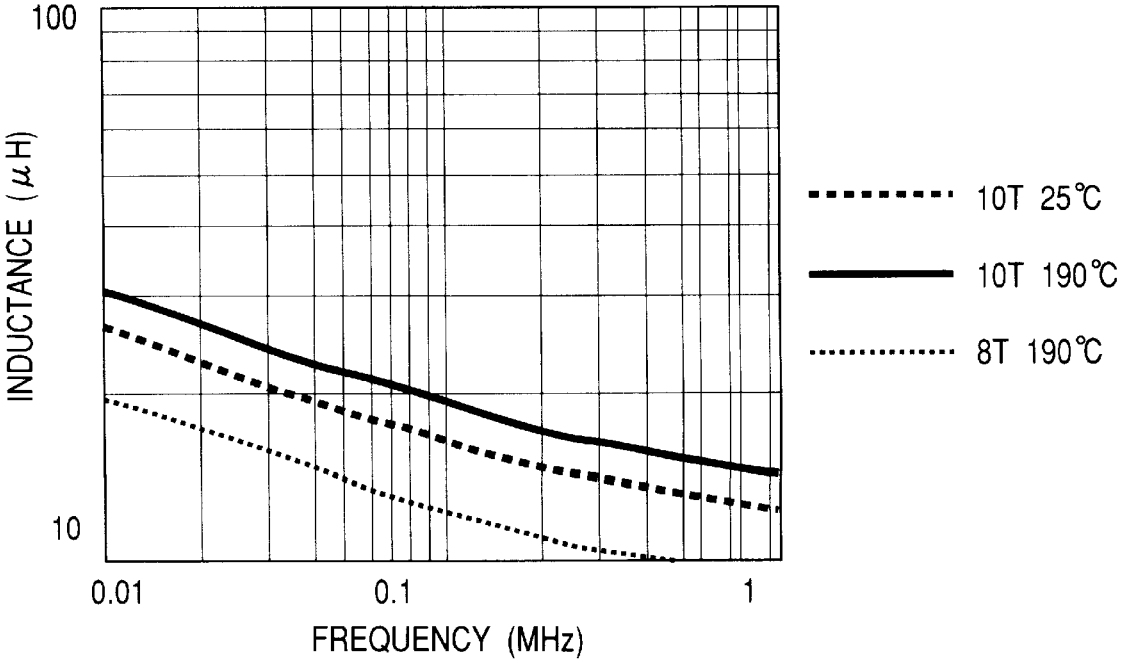
FIG. 6D shows the frequency characteristic of the Lf component of the induction heating apparatus.
Figure 6E:
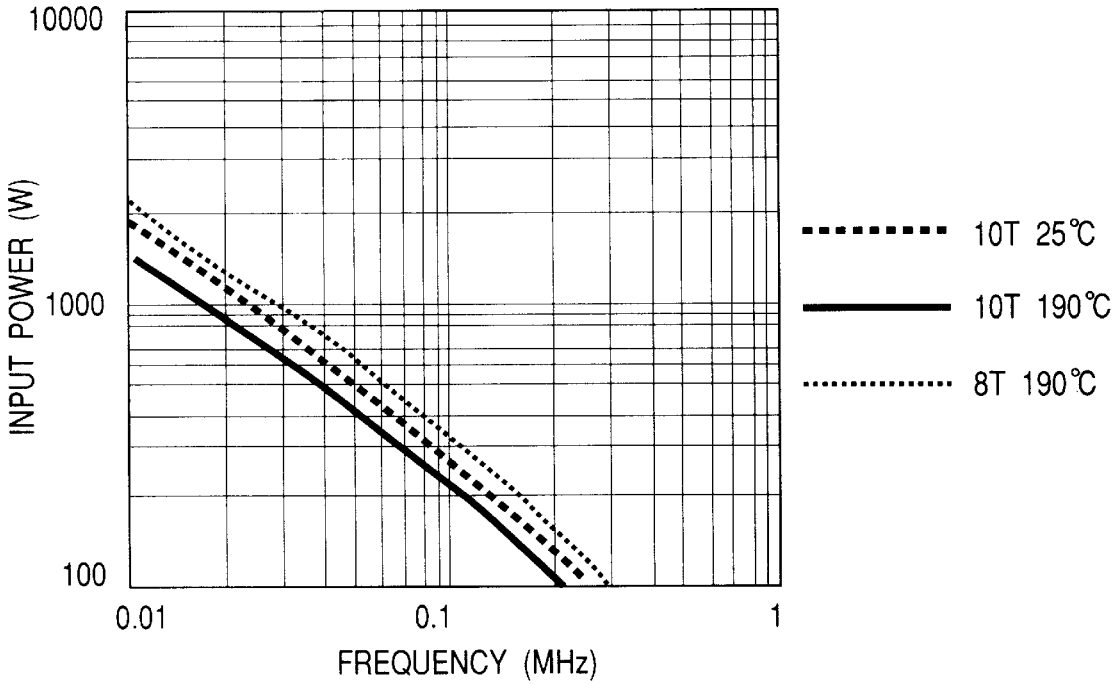
FIG. 6E shows the frequency characteristic of the input electric power of the induction heating apparatus.

That is, the result calculated from FIGS. 6A, 6B and 6C is the example of the frequency characteristic of the supplied electric power shown in FIG. 6E.

From FIG. 6E, it will be seen that the frequency of the variable frequency power source 10 is lowered, whereby the electric power supplied to the fixing apparatus can be increased, and when the input impedance of the excitation coil 2 is varied by the impedance varying means 20, the frequency characteristic of the supplied electric power shown in FIG. 6E is changed. The frequency of the variable frequency power source 10 can be changed so that the same electric power can be supplied in conformity with the changed frequency characteristic of the supplied electric power.

That is, even if the input impedance of the excitation coil 2 is varied by the impedance varying means as required during the rising of the electric power, the supplied electric power does not decrease and maximum electric power can continue to be supplied, and early temperature rising is obtained and quick start becomes possible.

Also, even if the input impedance of the excitation coil 2 is varied by the impedance varying means 20 as required when the temperature is stable, the same electric power to be supplied can continue to be supplied, and the change in the temperature can be made small and stable heat generation with little temperature ripple can be maintained.

Also, the heat conversion efficiency to the fixing roller 1 (=heat/supplied electric power to the fixing roller 1) when the input voltage (supplied electric power) is V is represented by the following expression (2):

$$\eta = \frac{Rf(\omega)}{Rc(\omega) + Rf(\omega)} \quad (2)$$

Figure 6F:
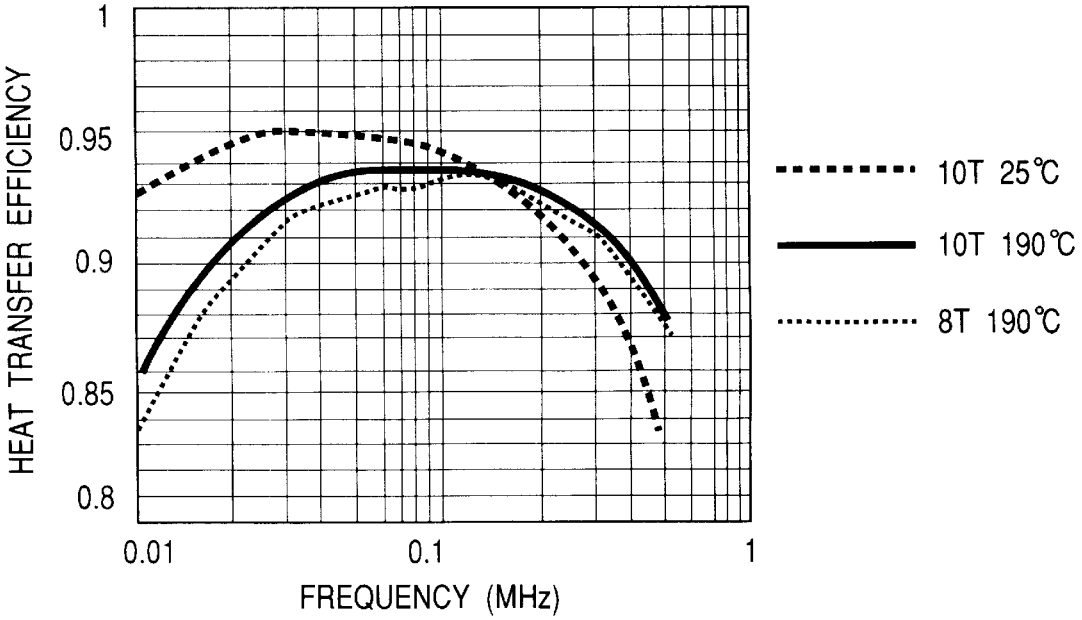
FIG. 6F shows the frequency characteristic of the heat converting efficiency of the induction heating apparatus.

FIG. 6F shows an example of the frequency characteristic of the heat transfer efficiency of the fixing roller 1. It will be seen from FIG. 6F that there is a frequency good in heat transfer efficiency. That is, by setting the frequency of the variable frequency power source 10 to the frequency good in heat transfer efficiency, it is possible to provide an induction heating and fixing apparatus good in efficiency.

Accordingly, it is possible to provide an induction heating and fixing apparatus which can obtain stable heat generation with little temperature ripple and good temperature rising and which is efficient and can effect quick start.

Embodiments 2 to 10 shown below are ones in which the above-described concept of the present invention is made more specific.

Embodiment 2 (FIGS. 7 to 10)

Figure 7:
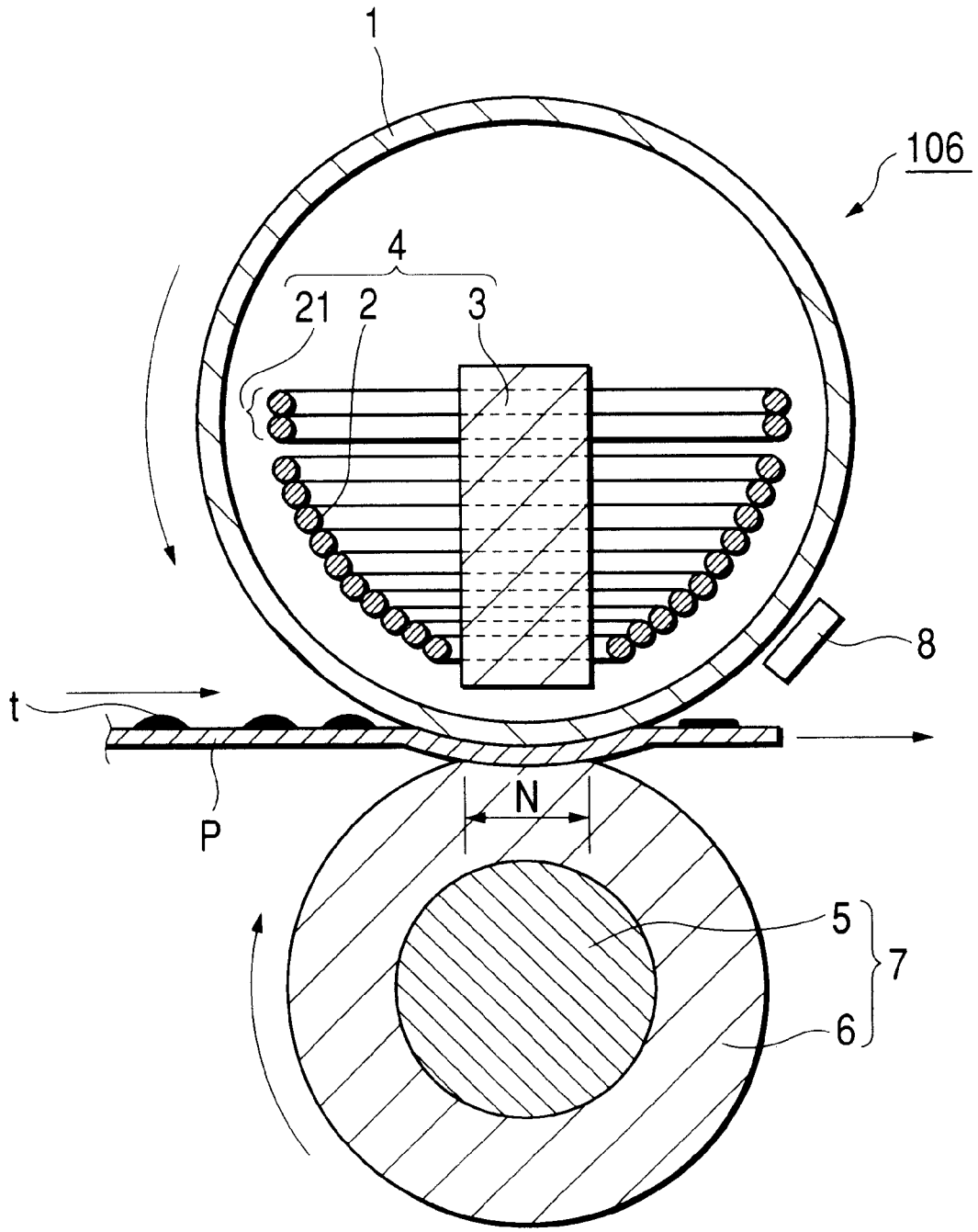
FIG. 7 is a cross-sectional view of an induction heating apparatus according to Embodiment 2.
Figure 8:
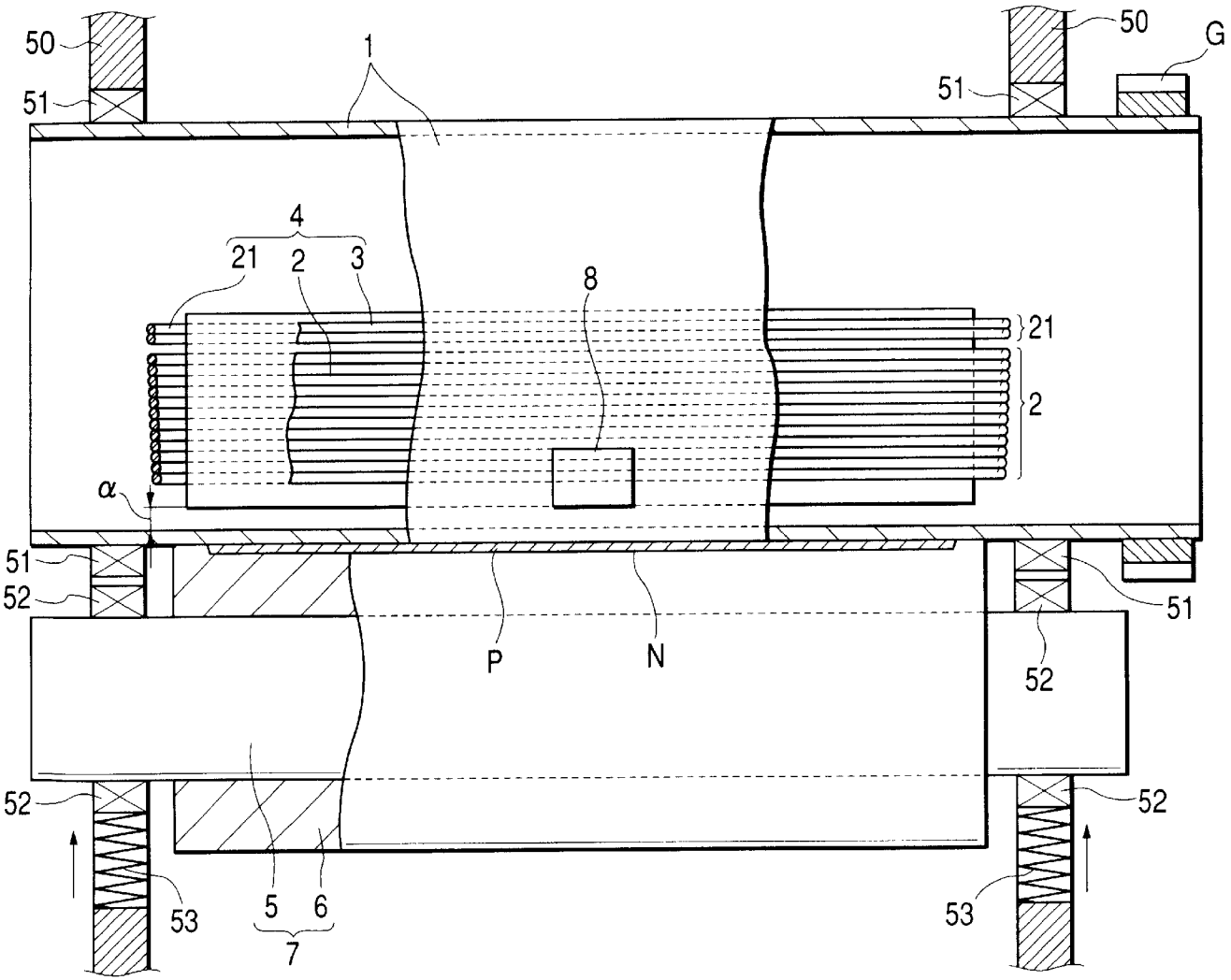
FIG. 8 is a partly cut-away side view of the induction heating apparatus of FIG. 7 as it is seen from a recording material discharging side.
Figure 9:
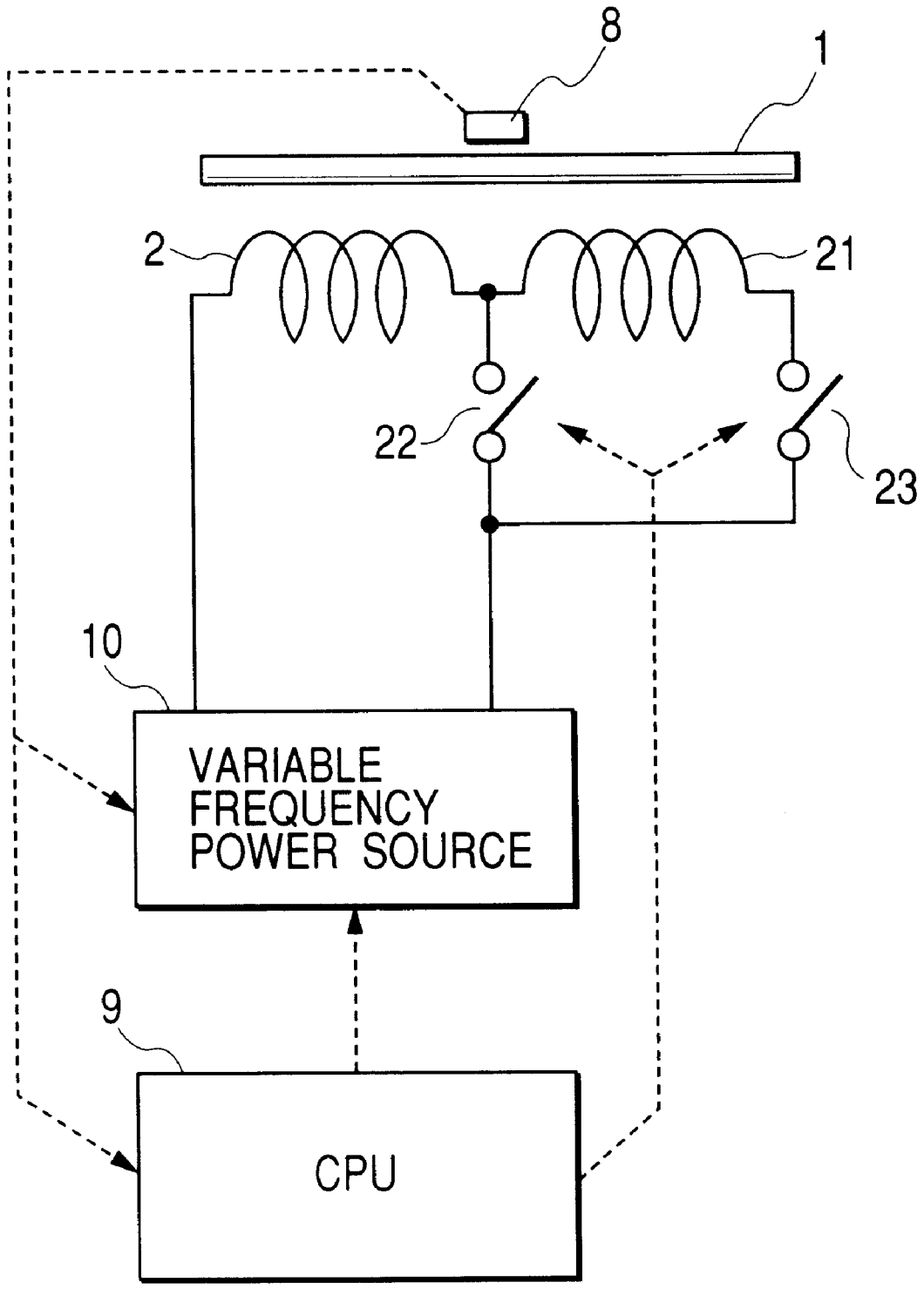
FIG. 9 is a model view of the essential portions of the induction heating apparatus of FIG. 7.
Figure 10:
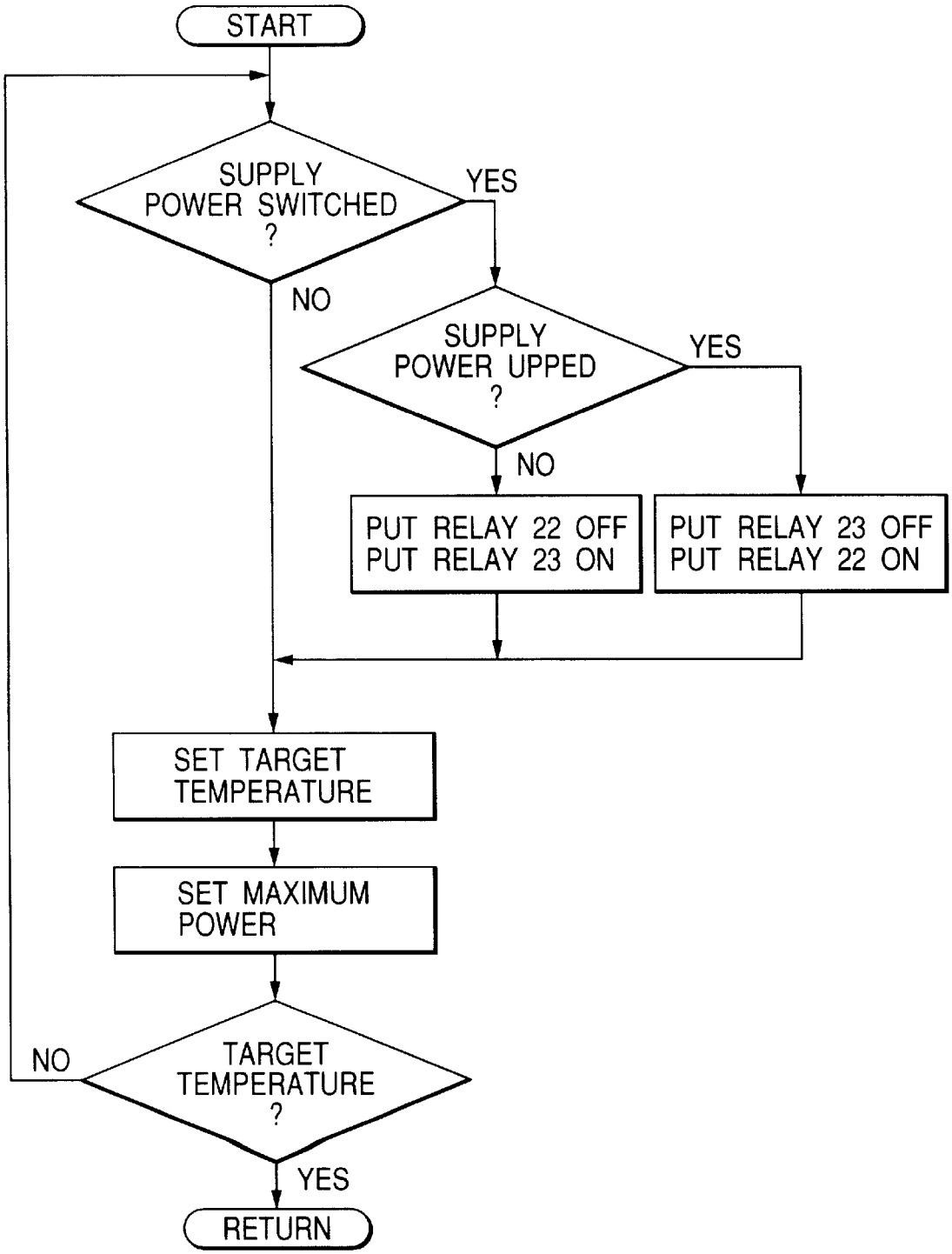
FIG. 10 is a flow chart showing the operation of Embodiment 2.

FIG. 7 is a transverse cross-sectional model view of a heating and fixing apparatus 106 according to Embodiment 2, and FIG. 8 is a partly cut-away rear model view (recording material exit side). FIG. 9 shows the construction of the apparatus, and FIG. 10 is an operation flow chart of a control system. Constituent members common to those of the heating and fixing apparatus of Embodiment 1 are given common reference numerals and need not be described again.

In this embodiment, a second excitation coil 21 is added in series to the excitation coil 2 so that a state in which electric power is supplied to only the excitation coil 2 and a state in which electric power is supplied to the excitation coil 2 and the second excitation coil 21 are changed over by the control of relays 22 and 23.

The excitation coil 2 is formed by a copper wire being wound a plurality of times, e.g. eight times, in one direction, the second excitation coil 21 is formed by a copper wire being wound a plurality of times, e.g. two times, in one direction, and the magnetic core 3 is disposed so as to be orthogonal to the copper wire of the excitation coil 2 and the copper wire of the second excitation coil 21 to thereby form a magnetic circuit.

In the foregoing, the second excitation coil 21 and the relays 22 and 23 together constitute impedance varying means for varying the input impedance of the excitation coil 2.

A temperature detecting element 8 such as a thermistor detects the temperature of the fixing roller 1, and the detected temperature information is inputted to the CPU 9 and the variable frequency power source 10.

The CPU 9 puts the relay 23 OFF and puts the relay 22 ON when it is necessary to change over the supplied electric power, for example, when it is desired to make the supplied electric power great, and puts the relay 22 OFF and puts the relay 23 ON when it is desired to make the supplied electric power small. Also, on the basis of the inputted detected temperature information and the then sequency state, the information of the target temperature of the fixing apparatus and the information of the maximum supplied electric power are indicated to the variable frequency power source 10.

The variable frequency power source 10 controls the supply of electric power to the excitation coil 2 on the basis of the detected temperature information, the information of the target temperature and the information of the maximum supplied electric power so that the temperature of the fixing nip part N may be controlled to a predetermined fixing temperature.

In the example of the frequency characteristic of the supplied electric power in FIG. 6E and the example of the frequency characteristic of the heat conversion efficiency of the fixing roller in FIG. 6F, there are shown examples in which "the number of turns of the coil is 10 turns and the temperature is 25°", "the number of turns of the coil is 10 turns and the temperature is 190°", and "the number of turns of the coil is 8 turns and the temperature is 190°".

First, during the raising of the fixing electric power, the CPU 9 puts the relay 22 OFF and puts the relay 23 ON, and the number of turns of the excitation coil is set to 10 turns (excitation coil 2+second excitation coil 21), and for the variable frequency power source 10, the maximum electric power information is set to allowable maximum electric power, and the information of the temperature is set to the temperature during standby.

From the frequency characteristic of supplied electric power in FIG. 6E, it will be seen that as the temperature of the fixing apparatus rises, the frequency of the variable frequency power source is lowered, whereby the same maximum electric power can be supplied.

Also, from the heat conversion efficiency of the fixing roller in FIG. 6F, it will be seen that when the temperature rises, the heat conversion efficiency of the fixing roller becomes bad if 10 turns is kept and therefore, the number of turns is changed over to 8 turns for which the frequency-heat conversion efficiency in the vicinity of 190° C. is substantially equal to that in the case of 10 turns. That is, when the temperature reaches a predetermined temperature, the CPU 9 puts the relay 23 OFF and puts the relay 22 ON, and the number of turns of the excitation coil is set to 8 turns (only the excitation coil 2), and for the variable frequency power source 10, the information of the temperature is set to the temperature during standby. At this time, the frequency of the variable frequency power source 10 can be increased, whereby the electric power supplied to the fixing apparatus can be made the same and the heat transfer efficiency of the fixing roller 1 becomes good.

That is, when in a state in which the number of turns of the coil is 10 turns, the temperature of the fixing roller 1 rises to the vicinity of 190° C. (for example, the electric power supply frequency at this time is 30 kHz), even if electric power is supplied at the same frequency as that when the temperature is low, the input electric power to the coil becomes lower than when the temperature is low, as shown in FIG. 6E (in the graph of FIG. 6E, the input electric power lowers from 750W to 600W). Accordingly, if in this state, that is, even when the temperature of the fixing roller is high, the control of the electric power supply to the coil is effected by the use of the "detected temperature-electric power supply frequency" table when the temperature of the fixing roller is low, desired electric power supply to the coil cannot be done.

So, as will be understood if reference is had to the characteristic shown in FIG. 6E, if the electric power supply frequency to the coil is lowered (for example, lowered from 30 kHz to 23 kHz), substantially the same input electric power (750W) as that when the temperature is 25° C. can be secured.

However, if the input electric power is lowered, the heat transfer efficiency in the fixing roller will greatly lower as indicated by the characteristic graph shown in FIG. 6F.

So, in the present embodiment, when the temperature of the fixing roller reaches 190° C., the number of turns of the coil used is decreased to 8 turns (the input impedance is varied). By the number of turns of the coil used being decreased to 8 turns (the input impedance being varied), from the characteristic shown in FIG. 6E, the frequency can be increased from 30 kHz to 40 kHz to obtain the same input electric power as the input electric power (750W) when the number of turns is 10 turns and the temperature is 25° C. As will be understood if reference is had to the characteristic shown in FIG. 6F, even if the number of turns of the coil is changed from 10 turns to 8 turns, the lowering of the heat conversion efficiency can be suppressed by increasing the frequency.

As described above, in the present embodiment, the number of turns of the coil after the temperature of the fixing roller has risen to a predetermined temperature is decreased from the number of turns of the coil until the temperature of the fixing roller rises to the predetermined temperature, and the electric power supply to the coil is controlled by the use of the "detected temperature-electric power supply frequency" table corresponding to each number of turns, whereby the lowering of the heat transfer efficiency can be suppressed and yet the input electric power necessary for the fixing roller to maintain the predetermined temperature can be secured.

Accordingly, there can be provided an electromagnetic induction heating and fixing apparatus which can obtain stable heat generation with little temperature ripple and good temperature rising and which is good in efficiency and can effect quick start. Further, there can be effected optimum electric power supply which is quick in rising and good in heat generating efficiency.

Embodiment 3 (FIGS. 11 to 14)

Figure 11:
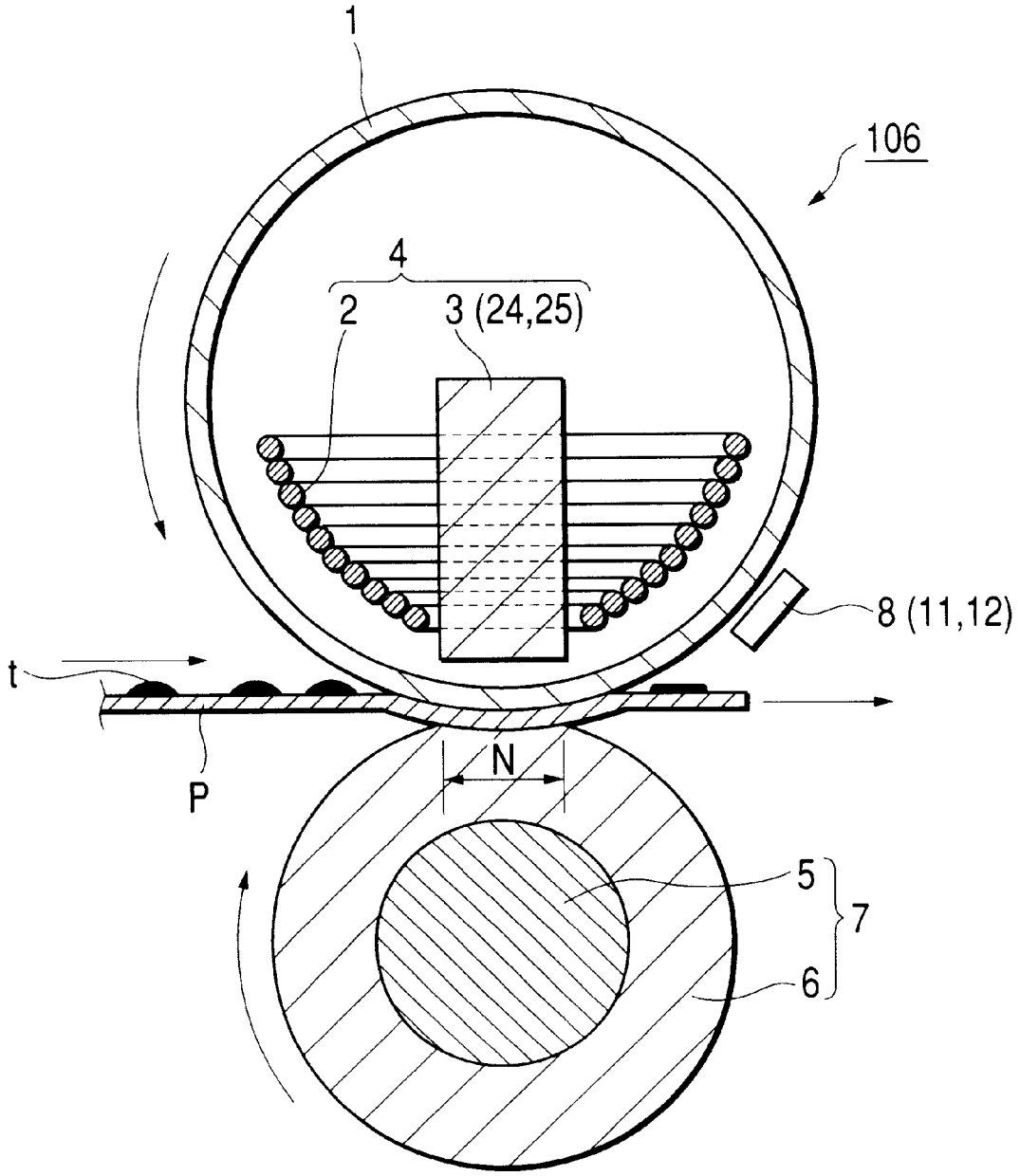
FIG. 11 is a cross-sectional view of an induction heating apparatus according to Embodiment 3.
Figure 12:
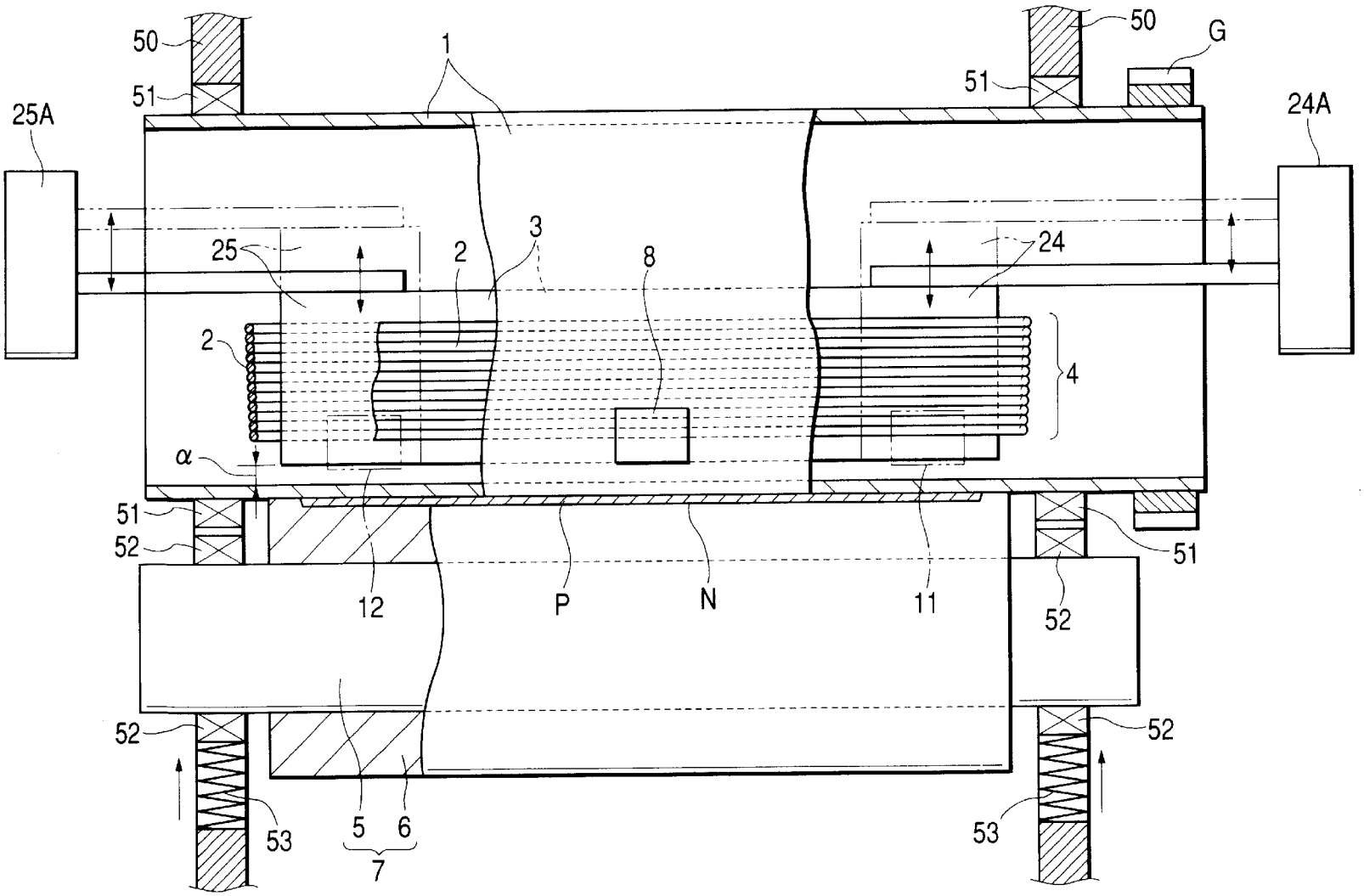
FIG. 12 is a partly cut-away side view of the induction heating apparatus of FIG. 11 as it is seen from a recording material discharging side.
Figure 13:
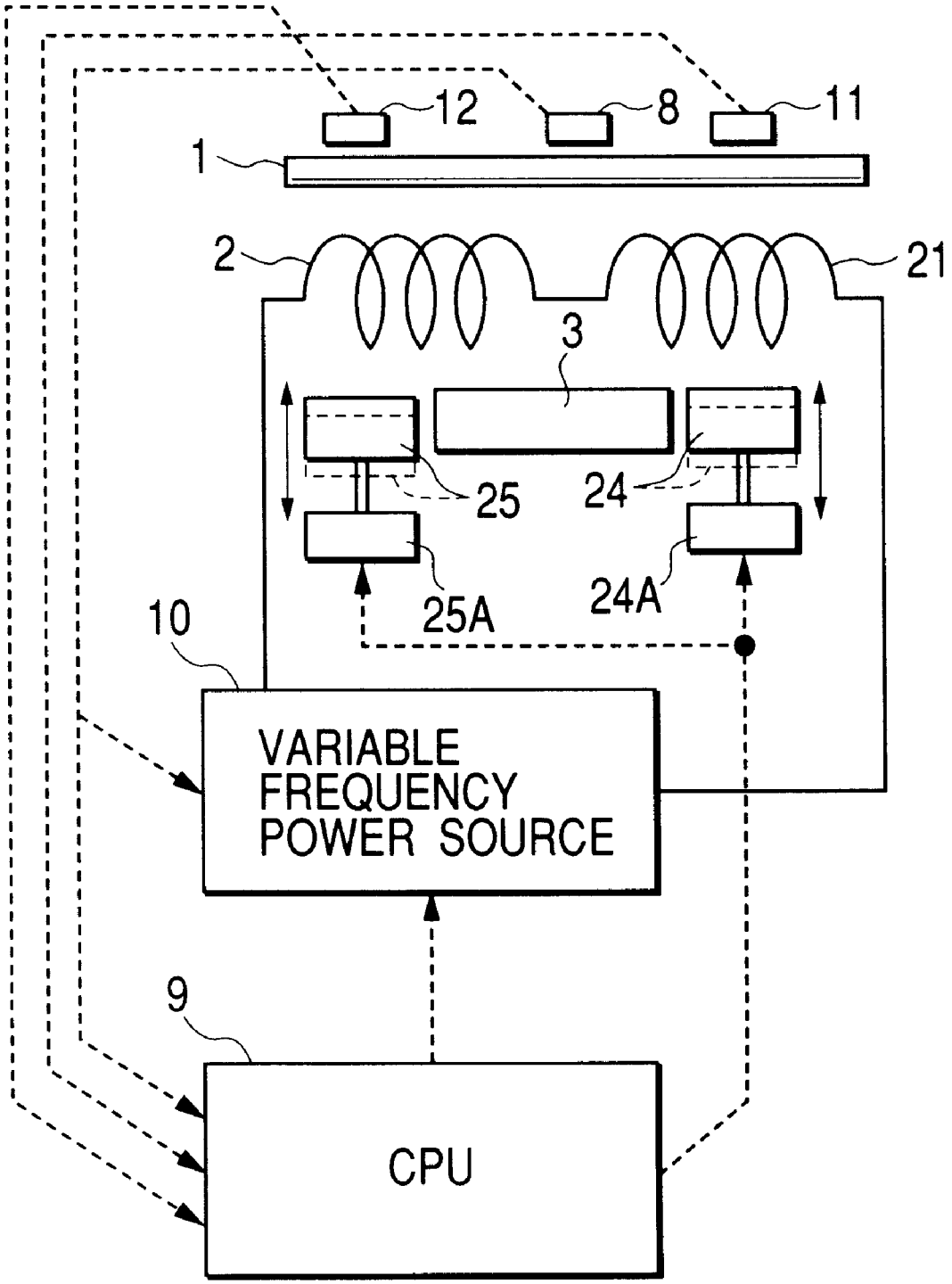
FIG. 13 is a model view of the essential portions of the induction heating apparatus of FIG. 11.
Figure 14:
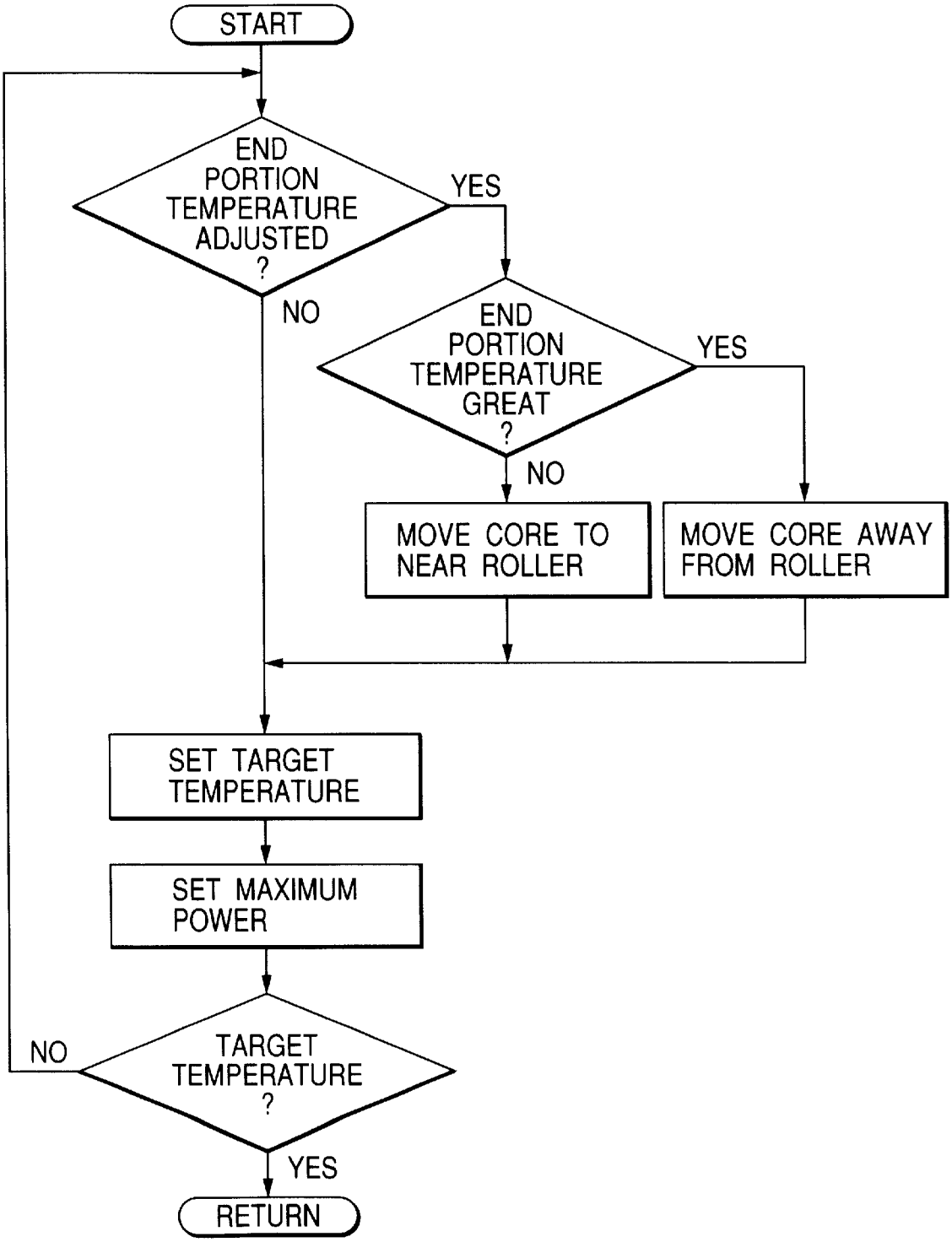
FIG. 14 is a flow chart showing the operation of Embodiment 3.

FIG. 11 is a transverse cross-sectional model view of a heating and fixing apparatus according to Embodiment 3, and FIG. 12 is a partly cut-away rear moder view (recording material exit side). FIG. 13 shows the construction of the apparatus, and FIG. 14 is an operation flow-chart of a control system. Constituent members and portions common to those of the heating and fixing apparatus of Embodiment 1 are given common reference numerals and need not be described again.

In the present embodiment, the magnetic core is made into a three-division member comprising a central (first) magnetic core 3 and second and third magnetic cores 24 and 25 on the opposite end portions, and the second and third magnetic cores 24 and 25 are designed to have their vertical movement controlled, or example, by vertically moving mechanisms 24A and 25A including an electromagnetic solenoid-plunger or the like.

An excitation coil 2 is formed by a copper wire being wound a plurality of times in one direction, and the magnetic core 3, the second magnetic core 24 and the third magnetic core 25 are disposed so as to be orthogonal to the copper wire of the excitation coil 2 to thereby form a magnetic circuit. The magnetic core 3, the second magnetic core 24 and the third magnetic core 25 are formed of a magnetic material, and each of them comprises, for example, a ferrite core or a laminated core.

In the foregoing, the second magnetic core 24, the third magnetic core 25 and the vertically moving mechanisms 24A and 25A together constitute impedance varying means. for varying the input impedance of the excitation coil 2.

The reference numerals 8, 11 and 12 designate three temperature detecting elements such as thermistors which are held in place at a location near the recording material exit of the fixing nip part N and substantially central of the lengthwise direction of the fixing roller 1 and locations at the opposite end portions of the fixing roller in closely opposed relationship with the fixing roller 1 by a supporting member, not shown.

The temperature detecting element 8 detects the temperature of the central portion of the fixing roller 1, and the detected temperature information is inputted to the CPU 9 and the variable frequency power source 10.

The second temperature detecting element 11 is disposed at a location facing the second magnetic core 24, and detects the temperature of a first end portion of the fixing roller 1, and the detected temperature information is inputted to the CPU 9.

The third temperature detecting element 12 is disposed at a location facing the third magnetic core 25, and detects the temperature of a second end portion of the fixing roller 1, and the detected temperature information is inputted to the CPU 9.

The CPU 9, if it is necessary to change over the heat supply to the end portions of the fixing roller 1, that is, (1) when it is desired to make the heat supply to a first end portion great, controls the vertically moving mechanism 24A to thereby move down the second magnetic core 24 to the vicinity of the inner surface of the fixing roller 1, (2) when it is desired to make the heat supply to a second portion great, controls the vertically moving mechanism 25A to thereby move down the third magnetic core 25 to the vicinity of the inner surface of the fixing roller 1 (3) when it is desired to make the heat supply to the first end portion small, controls the vertically moving mechanism 24A to thereby move up the second magnetic core 24 away from the inner surface of the fixing roller 1, and (4) when it is desired to make the heat supply to the second end portion small, controls the vertically moving mechanism 25A to thereby move up the third magnetic core 25 away from the inner surface of the fixing roller 1.

Also, the CPU 9 indicates the information of the target temperature of the fixing apparatus and the information of the maximum supplied electric power to the variable frequency power source 10 on the basis of the inputted detected temperature information of the central portion of the fixing roller 1 and the then sequence state.

The variable frequency power source 10 controls the electric power supply to the excitation coil 2 on the basis of the detected temperature information of the central portion of the fixing roller 1, the information of the target temperature and the information of the maximum supplied electric power so that the temperature of the fixing nip part N may be controlled to a predetermined fixing temperature.

When sheets of different width sizes are continuously passed, the temperatures of the central portion and end portions of the fixing roller 1 become different from one another, and this causes bad fixing. So, the CPU 9 can vertically move the second magnetic core 24 and the third magnetic core 25 at the end portions to thereby control the temperatures of the respective end portions of the fixing roller 1. However, by the cores 24 and 25 being moved, the input impedance of the excitation coil 2 is varied. By changing the frequency of the variable frequency power source 10 in conformity with the change in the input impedance of the excitation coil 2, it is possible to supply necessary optimum electric power. Also, the unnecessary resistance loss (current limiting resistance) or the like as in the prior art is not required.

That is, there can be provided an efficient electromagnetic induction heating and fixing apparatus in which the frequency of the variable frequency power source 10 can be set to a frequency good in heat transfer efficiency.

In conformity with necessary electric power, the frequency can be changed to thereby change the electric power, and optimum electric power supply good in heat generating efficiency can be done for the control of the uneven temperatures of the end portions.

Further, there can be provided an electromagnetic induction heating and fixing apparatus which is free of unnecessary resistance loss (current limiting resistance) or the like and good in heat generating efficiency.

Embodiment 4 (FIGS. 15 to 18)

Figure 15:
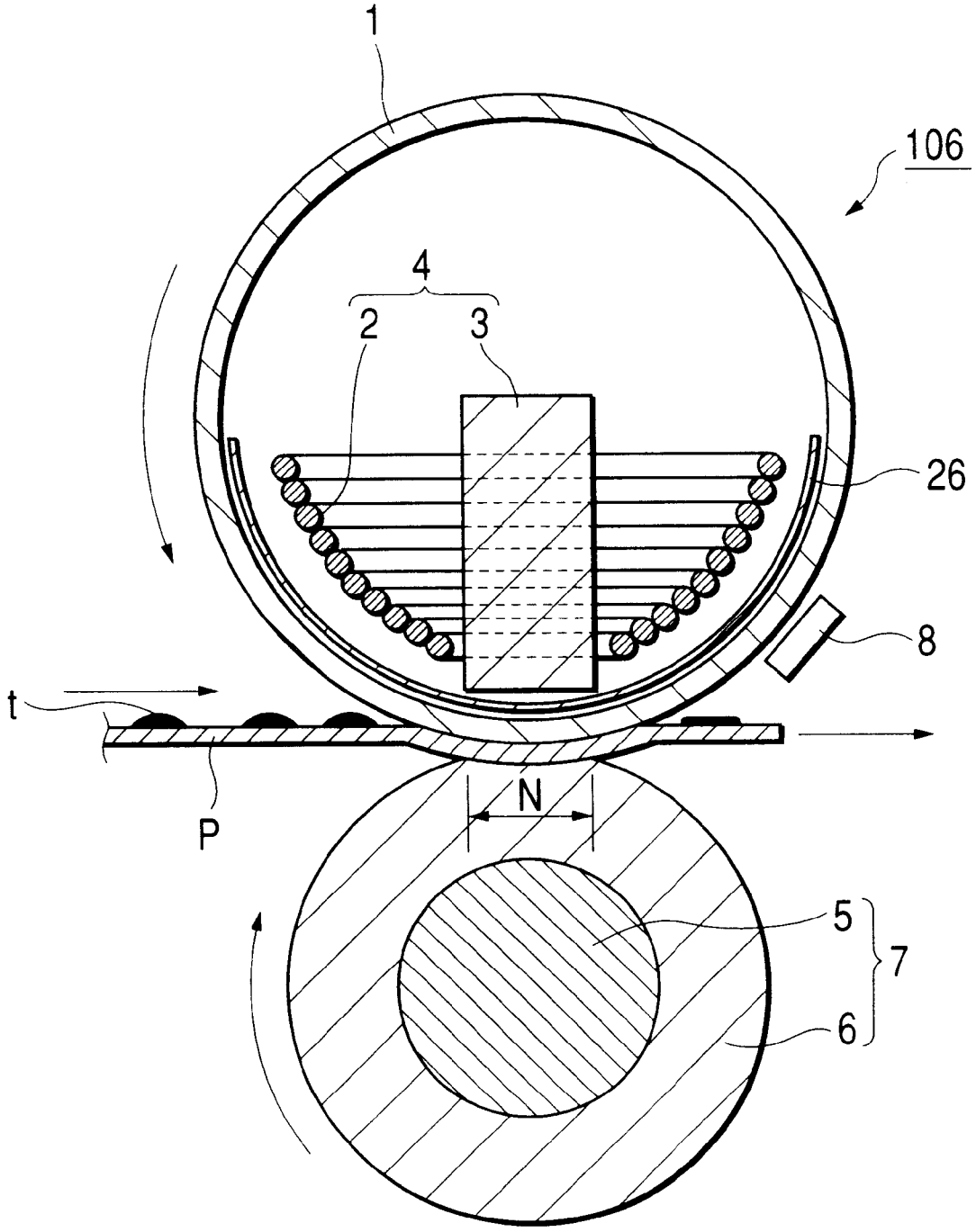
FIG. 15 is a cross-sectional view of an induction heating apparatus according to Embodiment 4.
Figure 16:
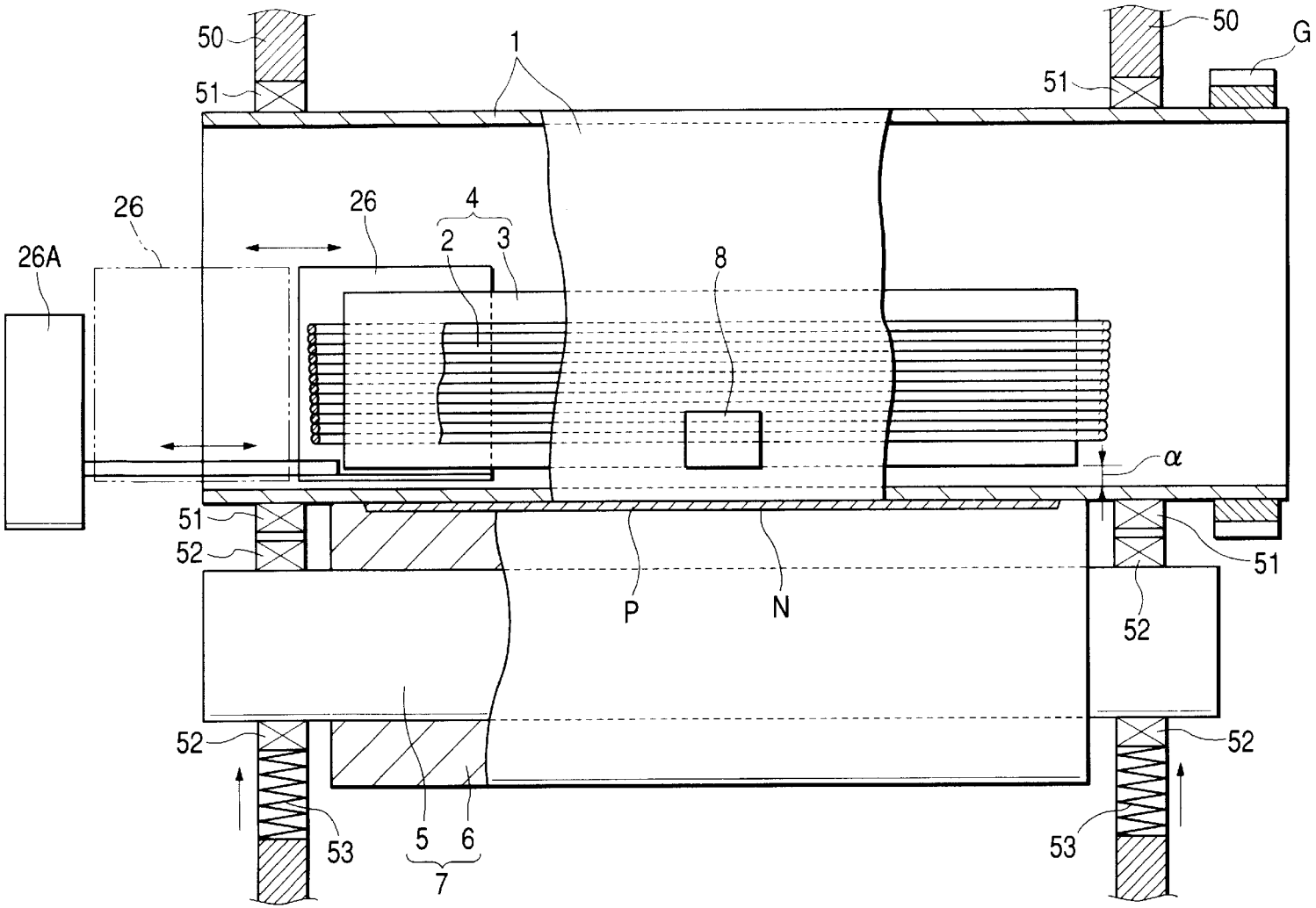
FIG. 16 is a partly cut-away side view of the induction heating apparatus of FIG. 15 as it is seen from a recording material discharging side.
Figure 17:
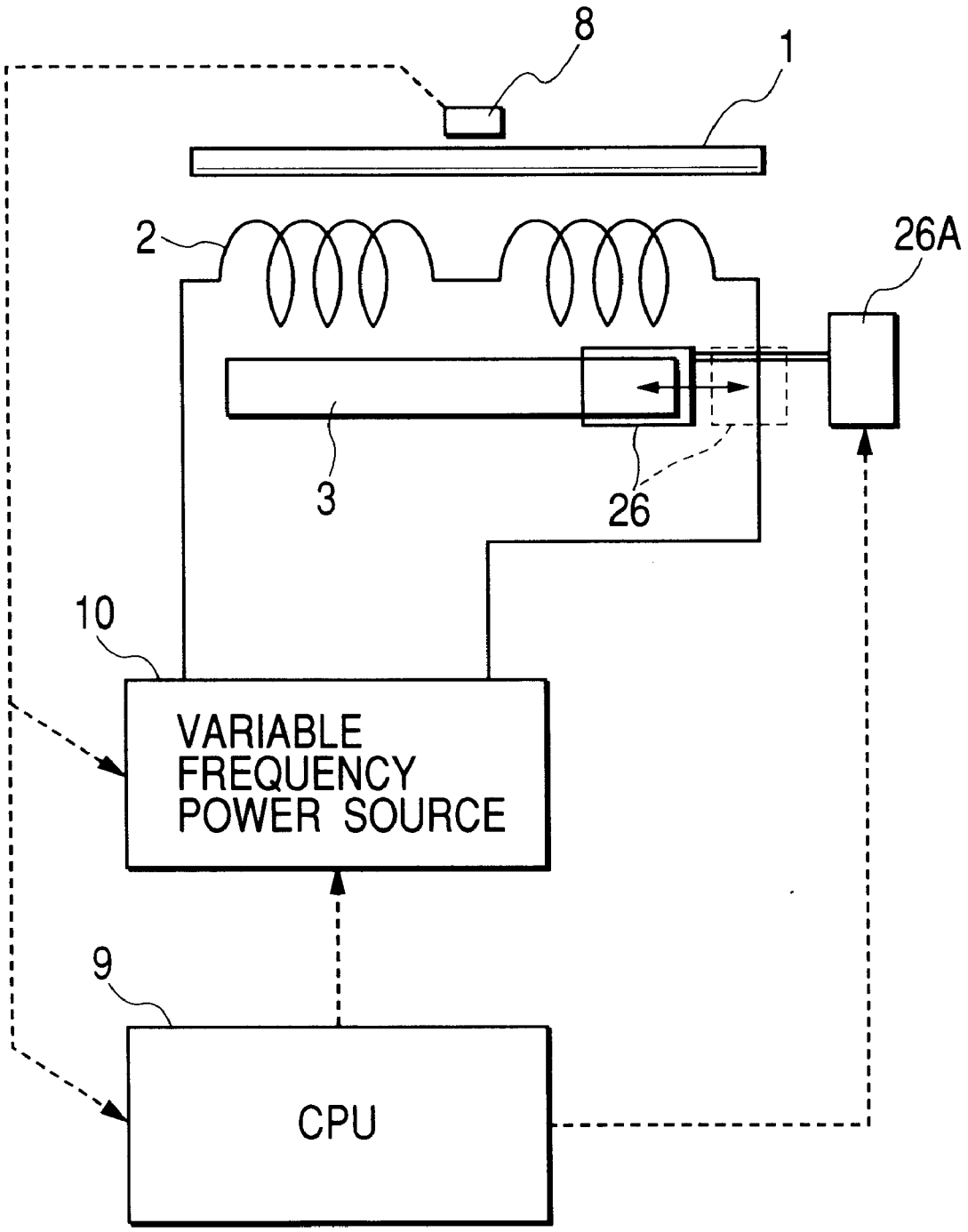
FIG. 17 is a model view of the essential portions of the induction heating apparatus of FIG. 15.
Figure 18:
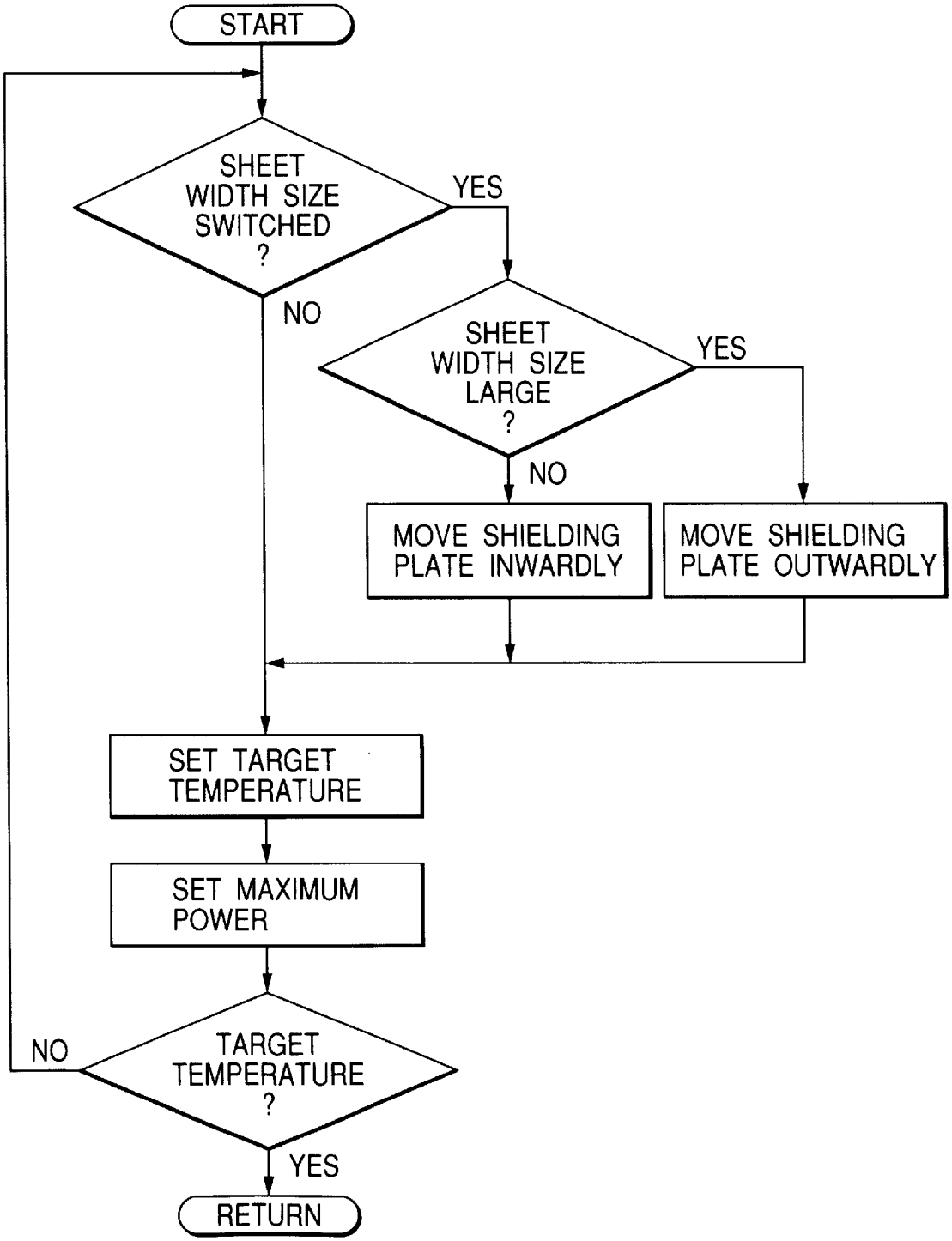
FIG. 18 is a flow chart showing the operation of Embodiment 4.

FIG. 15 is a transverse cross-sectional model view of a heating and fixing apparatus according to Embodiment 4, and FIG. 16 is a partly cut-away rear model view (recording material exit side) thereof. FIG. 17 shows the construction of the apparatus, and FIG. 18 is an operation flow chart of a control system. Constituent members and portions common to those of the heating and fixing apparatus of Embodiment 1 are given common reference numerals and need not be described again.

In the present embodiment, a magnetic shielding member 26 movable into and out of the gap a between the inner surface of the fixing roller 1 and the magnetic field generating means assembly 4 is provided on one end portion side of the fixing roller 1, and the member 26 is designed to be movement-controlled in an out of the fixing roller, for example, by a forward and backward moving mechanism 26A including an electromagnetic solenoid-plunger or the like.

In the foregoing, the magnetic shielding member 26 and the forward and backward moving mechanism 26A together constitute impedance varying means for varying the input impedance of the excitation coil 2.

The temperature of the fixing roller 1 is detected by the temperature detecting element 8, and the detected temperature information is inputted to the CPU 9 and the variable frequency power source 10.

The CPU 9, if it is necessary to change over the heat supply to the end portions of the fixing roller 1, that is, (1) when it is desired to make the heat supply to the end portions of the fixing roller great, controls the forward and backward moving mechanism 26A to thereby move the magnetic shielding member 26 out of the gap a to the outside of the roller, and (2) when it is desired to make the heat supply to the end portions of the fixing roller small, controls the forward and backward moving mechanism 26A to thereby move the magnetic shielding member 26 into the gap a and move it to the inside of the roller.

Also, the CPU 9 indicates the information of the target temperature of the fixing apparatus and the information of maximum supplied electric power to the variable frequency power source 10 on the basis of the inputted detected temperature information of the central portion of the fixing roller 1 and the then sequence state.

The variable frequency power source 10 controls the electric power supply to the excitation coil 2 on the basis of the detected temperature information of the central portion of the fixing roller 1, the information of the target temperature and the information of the maximum supplied electric power so that the temperature of the fixing nip part N may be controlled to a predetermined fixing temperature.

When a sheet of a sheet width size equal to the width of the fixing apparatus is passed, the magnetism intercepting member 26 is moved to the outside of the fixing roller 1, and fixing is effected with the sheet width size. When a sheet of a sheet width size smaller than the width of the fixing apparatus is passed, the magnetic shielding member 26 can be moved to a non-sheet passing area inside the fixing roller 1 in conformity with the sheet width size to thereby suppress the temperature rise of the end portions.

That is, the CPU 9 can move the magnetic shielding member 26 to thereby control the temperature of the end portions of the fixing roller. However, by the magnetic shielding member 26 being moved, the input impedance of the excitation coil 2 is changed. The frequency of the variable frequency power source 10 is changed in conformity with the change in the input impedance of the excitation coil 2, whereby necessary optimum electric power can be supplied.

That is, necessary optimum electric power supply good in heat generating efficiency can be effected in conformity with the size of a material to be heated, and optimum electric power supply good in heat generating efficiency can be effected in conformity with the size.

Figure 19A:
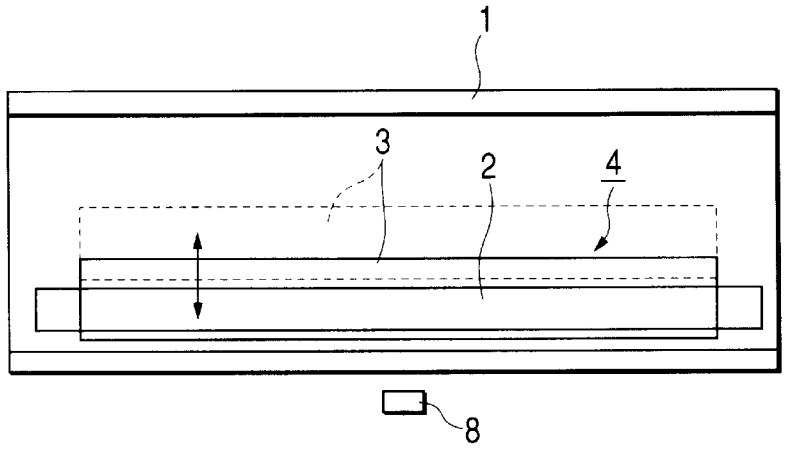
FIGS. 19A, 19B and 19C are side views illustrating a method of changing the input impedance of an induction heating apparatus according to Embodiment 5.
Figure 19B:
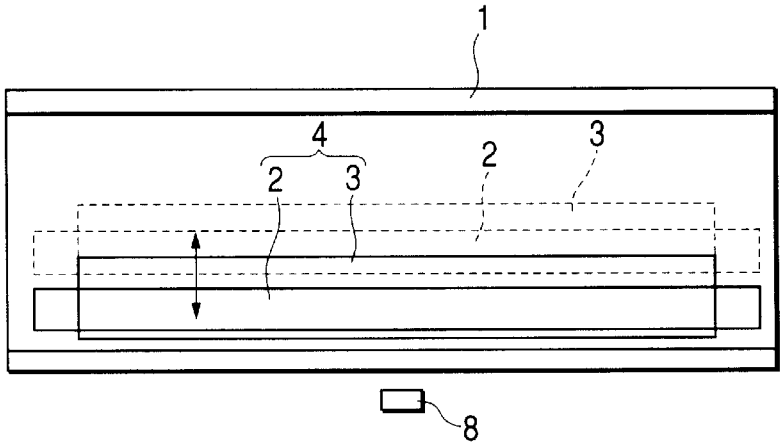
Figure 19C:
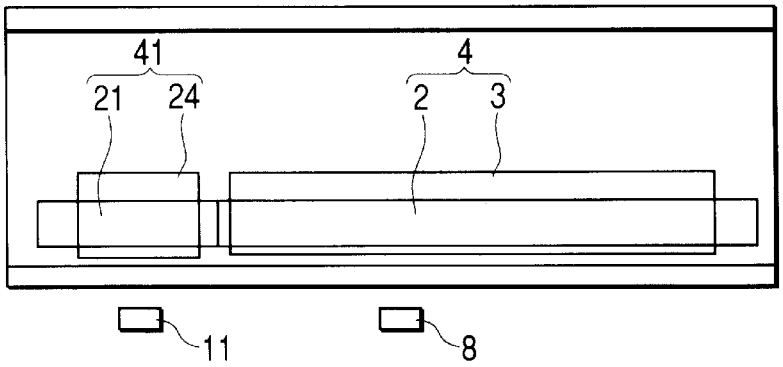

Embodiment 5 (FIGS. 19A to 19C)

What is shown in FIG. 19A is of a construction in which the magnetic core 3 of the magnetic field generating means assembly 4 has its vertical movement controlled by a vertically moving mechanism (not shown).

The CPU, if it is necessary to change over the supplied electric power, that is, (1) when it is desired to make the supplied electric power great, controls the vertically moving mechanism to thereby move down the magnetic core 3 to the vicinity of the inner surface of the fixing roller 1, and (2) when it is desired to make the supplied,electric power small, controls the vertically moving mechanism to thereby move up the magnetic core 3 away from the inner surface of the fixing roller 1. Thus, an effect similar to that of the aforedescribed Embodiment 2 can be obtained.

What is shown in FIG. 19B is of a construction in which the whole of the excitation coil 2 and magnetic core 3 of the magnetic field generating means assembly 4 has its vertical movement controlled by a vertically moving mechanism (not shown).

The CPU, if it is necessary to change over the supplied electric power, that is, (1) when it is desired to make the supplied electric power great, controls the vertically moving mechanism to thereby move down the magnetic field generating means assembly 4 to the vicinity of the inner surface of the fixing roller 1, and (2) when it is desired to make the supplied electric power small, controls the vertically moving mechanism to thereby move up the magnetic field generating means assembly 4 away from the inner surface of the fixing roller 1. Thus, an effect similar to that of the aforedescribed Embodiment 2 can be obtained.

In what is shown in FIG. 19C, a magnetic field generating means assembly comprising an excitation coil and a magnetic core is comprised of a main magnetic field generating means assembly 4 comprising an excitation coil 2 and a magnetic core 3, and an end portion magnetic field generating means assembly 41 comprising a second excitation coil 21 and a second magnetic core 24.

The CPU, if it is necessary to change over the heat supply to the end portions of the fixing roller 1, that is, (1) when it is desired to make the heat supply to the end portions of the roller great, controls a vertically moving mechanism (not shown) to thereby move the second magnetic core 24 to the vicinity of the inner surface of the fixing roller, and (2) when it is desired to make the heat supply to the end portions of the roller small, controls the vertically moving mechanism to thereby move the second magnetic core 24 away from the inner surface of the fixing roller, whereby an effect similar to that of Embodiment 3 can be obtained.

Also, by making the movement location of the second magnetic core 24 equal to the sheet width size, these can be obtained an effect similar to that of Embodiment 4.

Also, in the electromagnetic induction heating and fixing apparatus shown in FIG. 19C, the CPU, if it is necessary to change over the heat supply to the end portions of the fixing roller 1, that is, (1) when it is desired to make the heat supply to the end portions of the roller great, controls the vertically moving mechanism (not shown) to thereby move the whole of the end portion magnetic field generating means assembly 41 comprising the second excitation coil 21 and the second magnetic core 24 to the vicinity of the inner surface of the fixing roller 1, and (2) when it is desired to make the heat supply to the end portions of the roller small, controls the vertically moving mechanism to thereby move the whole of the end portion magnetic field generating means assembly 41 comprising the second excitation coil 21 and the second magnetic core 24 away from the inner surface of the fixing roller 1, whereby there can be obtained an effect similar to that of Embodiment 3.

Also, by making the movement location of the end portion magnetic field generating means assembly 41 comprising the second excitation coil 21 and the second magnetic core 24 equal to the sheet width size, there can be obtained an effect similar to that of Embodiment 4.

Also, in the electromagnetic induction heating and fixing apparatus shown in FIG. 19C, the CPU, if it is necessary to change over the heat supply to the end portions of the fixing roller 1, that is, (1) when it is desired to make the heat supply to the end portions of the roller great, moves the magnetism intercepting member 26 to the outside of the roller as in Embodiment 4, and (2) when it is desired to make the heat supply to the end portions of the roller small, moves the magnetic shielding member (26) to the inside of the roller. By changing the amount of movement in conformity with the temperature, there can be obtained an effect similar to that of Embodiment 4.

Thus, during the movement of the magnetic core, the excitation coil, the intercepting member or the magnetism absorbing member, or during the changeover of a plurality of excitation coils, the frequency can be changed in conformity with necessary electric power to thereby effect electric power supply good in heat generating efficiency.

Figure 20:
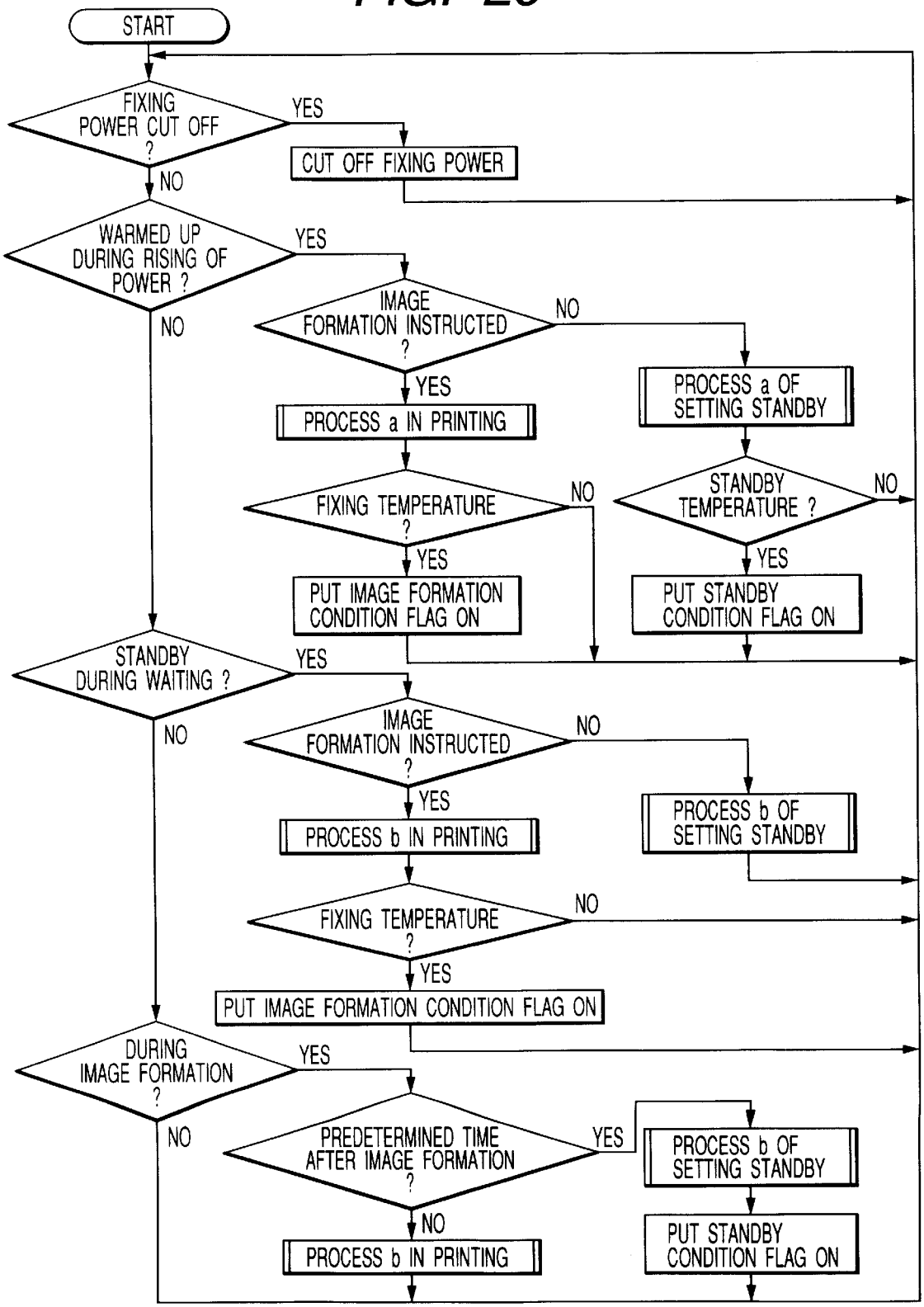
FIG. 20 is a flow chart showing the-operations of Embodiments 6 to 8.
Figure 21:
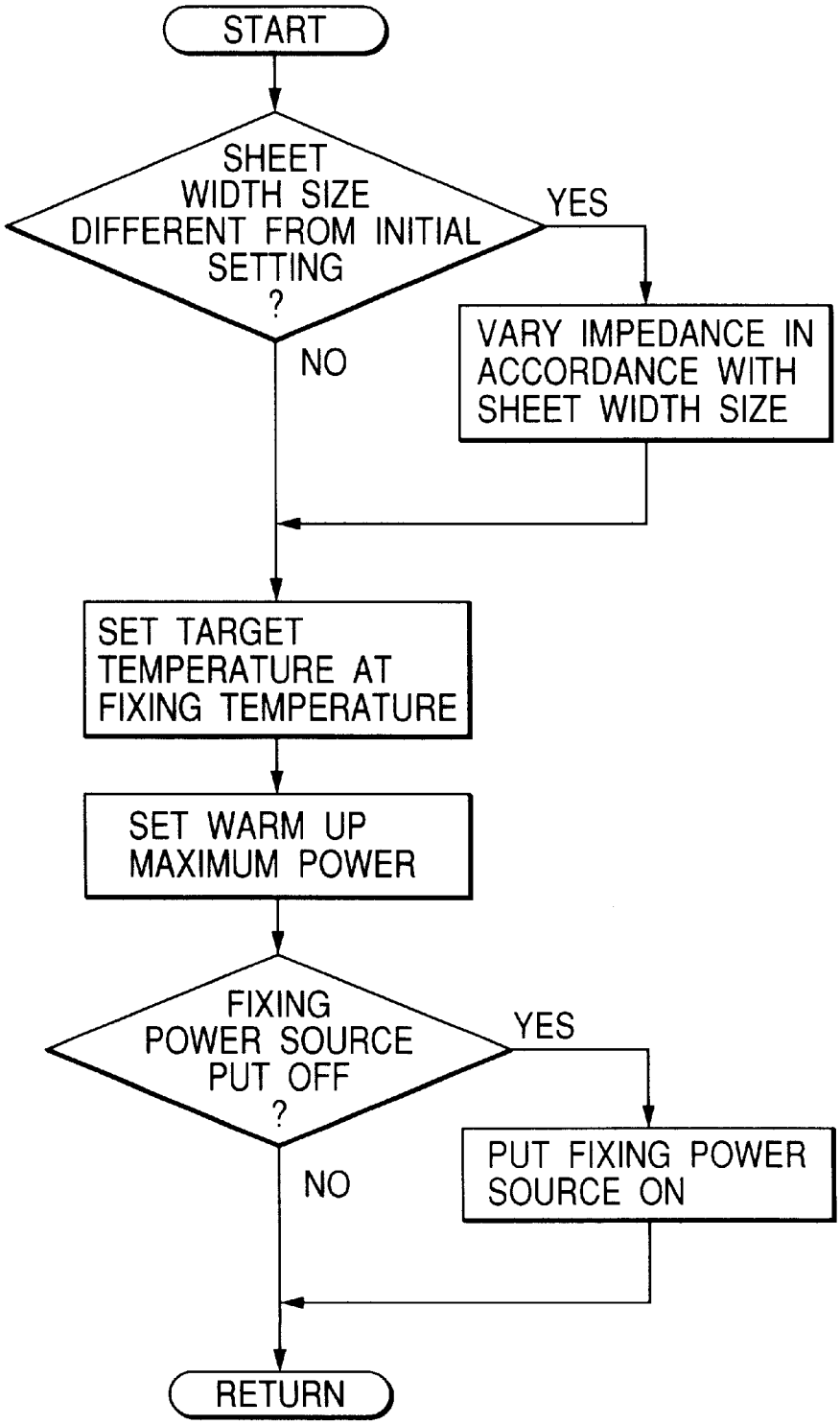
FIGS. 21 and 22 are flow charts showing the operation of Embodiment 6.
Figure 22:
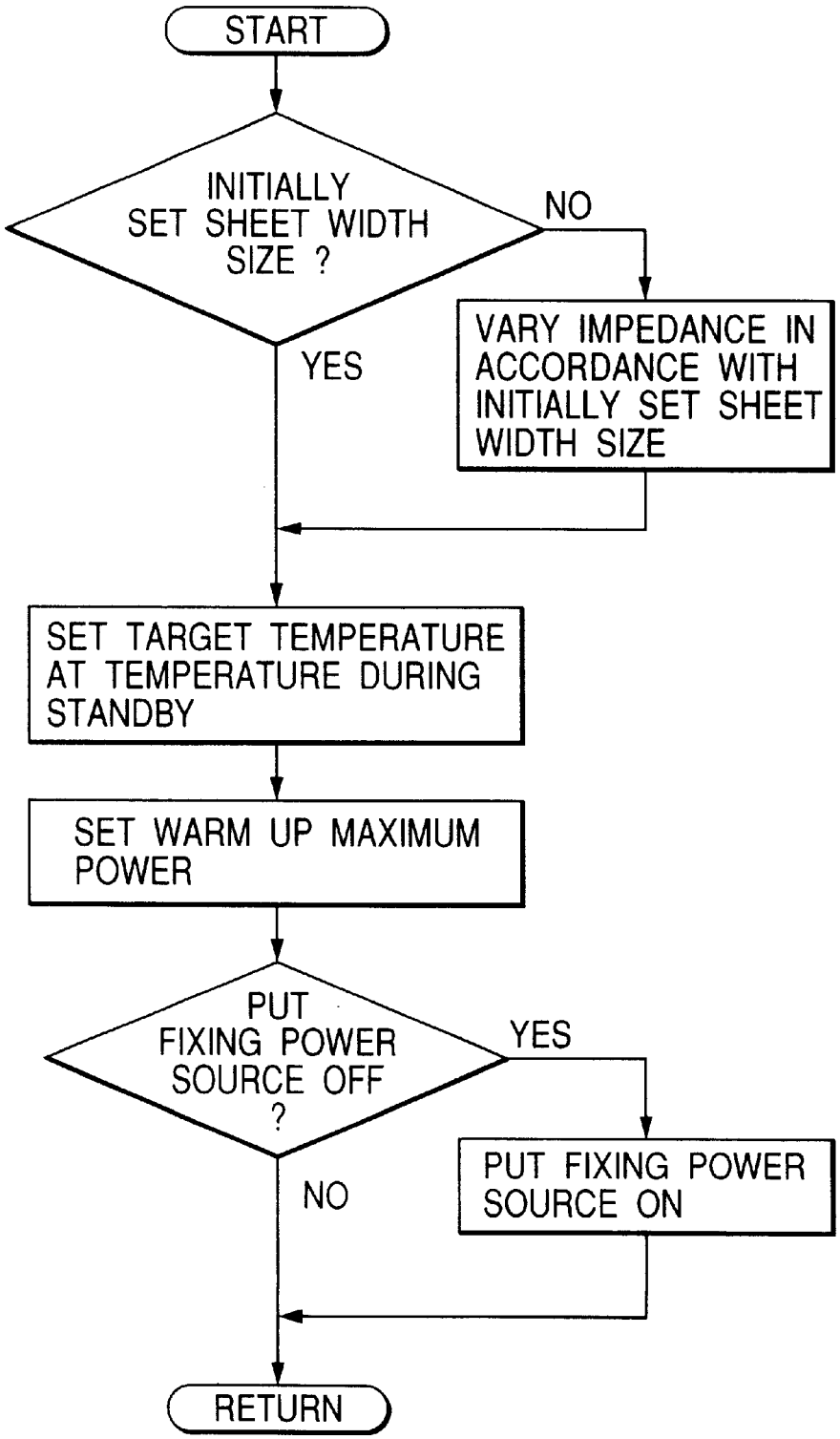

Embodiment 6 (FIGS. 20 to 22)

Embodiment 6 will hereinafter be described with reference to the drawings. FIGS. 20, 21 and 22 are flowcharts for illustrating an electromagnetic induction heating and fixing apparatus according to Embodiment 6. In the present embodiment, description will be made of the operation of the apparatus when a printing command has entered during the warm-up of the fixing device.

The general construction of the apparatus is similar to that of the aforedescribed Embodiment 1 shown in FIGS. 2 and 3 and therefore the whole of the apparatus need not be described. Also, the operation of each portion is similar to that in the aforedescribed Embodiments 1 to 4 and therefore need not be described except different portions.

In FIG. 20, a CPU 10 judges whether the fixing electric power should be cut off, and when it should be cut off, the power source of the fixing apparatus is put off.

Next, when the temperature of the fixing apparatus should be raised, it is rendered into a warm-up state and image forming instructions are waited for, and since there are no instructions at first, advance is made to the process a of setting standby.

The process a of setting standby operates the impedance varying means as shown in Embodiments 2 to 5 in a direction to prevent the temperature rise of a non-sheet passing portion in conformity with the sheet width size initially set in FIG. 22.

Next, the target temperature is set at a standby temperature equal to or lower than the temperature during image formation, and is inputted to the variable frequency power source.

Next, the maximum electric power allowed during warm-up is inputted to the variable frequency power source. Next, the fixing power source is switched on. However, if the fixing power source need be switched off during an abnormality or the like, it is switched off.

Next, if the temperature detected by the temperature detecting element 8 has reached the standby temperature, a standby state flag is set, and shift is made to the standby state.

If the detected temperature has not yet reached the standby temperature, the warm-up state is continued.

If there are instructions for image formation during the warm-up, advance is made to a process a in printing. The process a in printing operates the impedance varying means in the direction to prevent the temperature rise of the non-sheet passing portion, when in FIG. 21, a sheet size differing from an initially set one is first designated, in conformity with that sheet size.

Next, the target temperature is set at the temperature during image formation (the fixing temperature), and is inputted to the variable frequency power source.

Next, the maximum electric power allowed during the warm-up from the standby temperature to the fixing temperature is inputted to the variable frequency power source. The fixing power source, if it need be switched off during an abnormality or the like, is switched off.

Next, if the temperature detected by the temperature detecting element 8 has reached the fixing temperature, an image forming state flag is set, and shift is made to the image forming state.

If the detected temperature has not yet reached the fixing temperature, the warm-up state is continued.

That is, at the start of the temperature rise of the fixing roller 1, the input impedance of the excitation coil is varied in conformity with the initially set sheet width size by the impedance varying means, and the maximum electric power is supplied to the excitation coil. If there is designated a sheet size differing from the initially set one, at that point of time, the input impedance of the excitation coil is varied in conformity with the designated size by the impedance varying means, and the frequency of an electric current supplied from an alternating current source to the excitation coil is varied. Thereby, the supply of the maximum electric power can be effected in conformity with the sheet width size, and the rising can be quickened.

After the temperature of the fixing roller has risen to the fixing temperature, a sheet bearing a toner image thereon is passed to the fixing device. During fixing, the frequency of the supplied electric power to the coil is controlled by the use of a "temperature-frequency" table corresponding to the then input impedance.

Accordingly, there can be provided an induction heating and fixing apparatus in which the frequency can be changed in conformity with the overall necessary electric power and electric power supply good in heat generating efficiency can be effected, and stable heat generation with little temperature ripple and good temperature rising can be obtained, and efficiency is good and quick start is possible.

Further, in conformity with a necessary sheet size, temperature rising can be quickly accomplished with limited electric power, and image formation can be done immediately. Also, the temperature fluctuation of the fixing roller during fixing can be suppressed to a small level.

Embodiment 7

There can be provide an induction heating and fixing apparatus in which in Embodiment 6, the initially set sheet width size is set to a small size, whereby when the fixing device is to be warmed up, partial heating will suffice and temperature rising become more quickly possible and quick start is possible.

Figure 23:
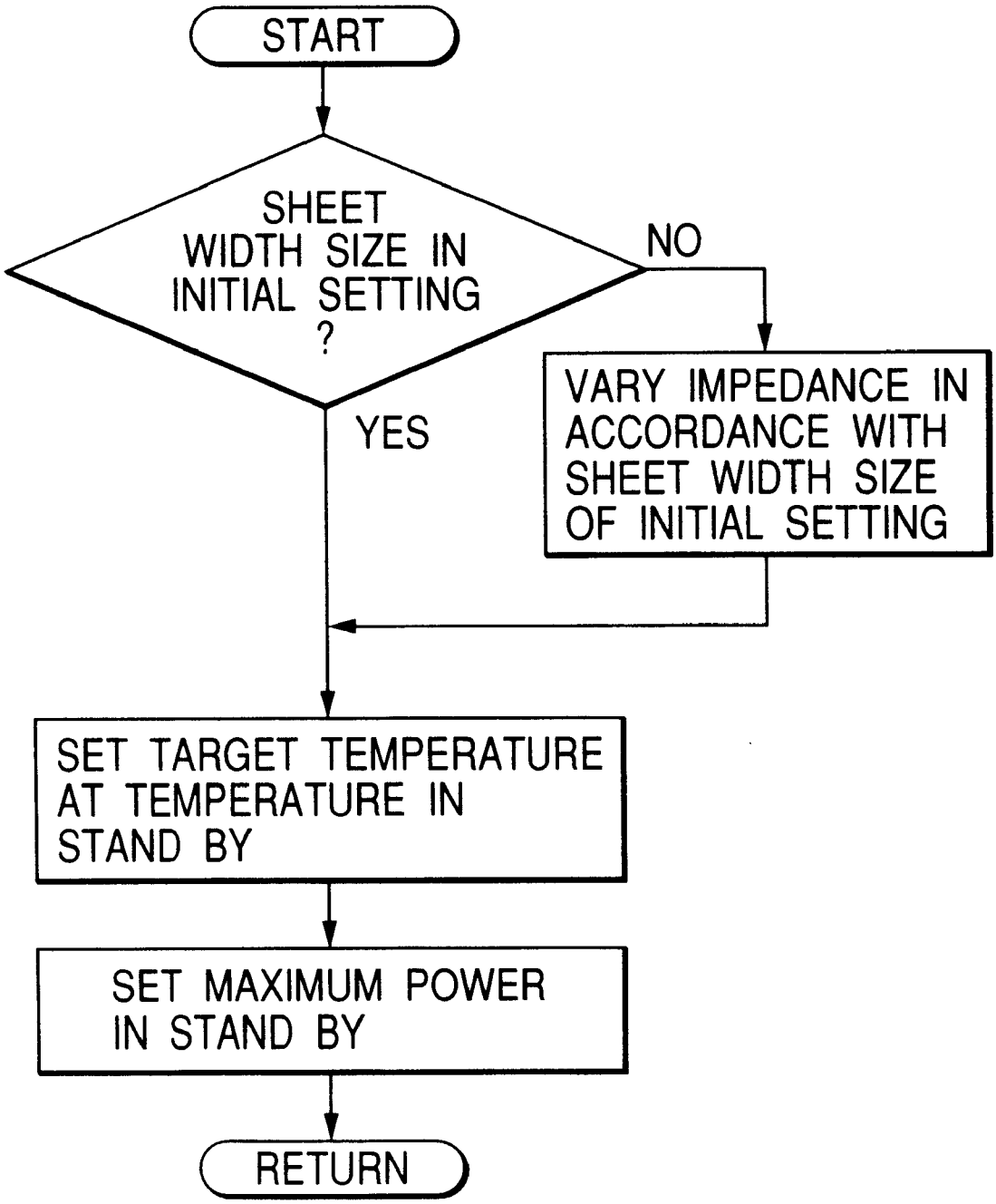
FIGS. 23 and 24 are flow charts showing the operation of Embodiment 8.
Figure 24:
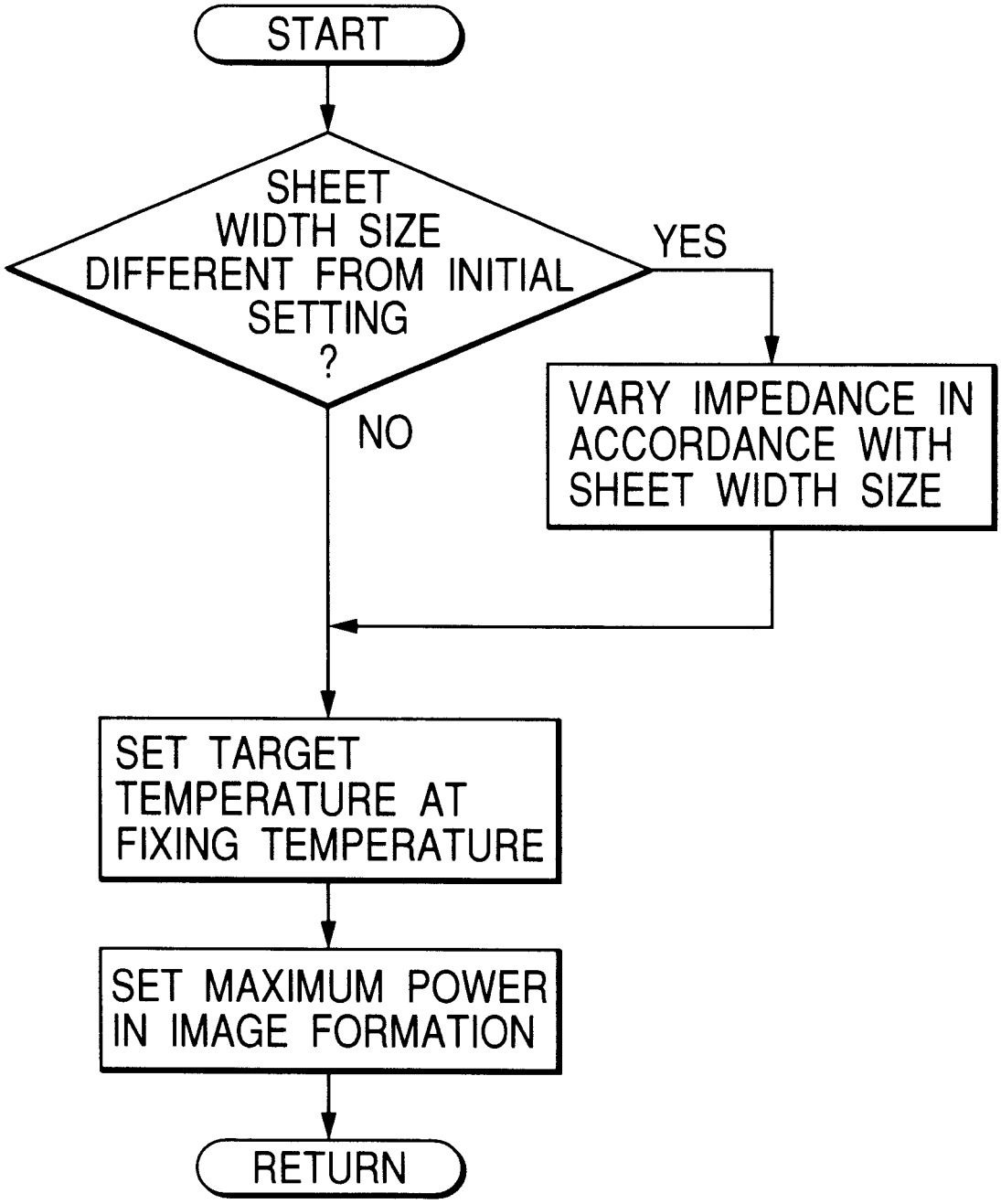

Embodiment 8 (FIGS. 20, 23 and 24)

Embodiment 8 will hereinafter be described with reference to the drawings. FIGS. 20, 23 and 24 are flow charts for illustrating an electromagnetic induction heating and fixing apparatus according to Embodiment 8. In this embodiment, description will be made of the operation of the apparatus when a printing command is not inputted when the fixing device is being warmed up to a standby condition, and the fixing device stands by while maintaining the standby temperature.

The general construction of the apparatus is similar to that of the aforedescribed Embodiment 1 shown in FIGS. 2 and 3 and therefore, the description of the whole of the apparatus will be omitted. The operation of each portion is similar to that in the aforedescribed Embodiments 1 to 4 and therefore need not be described except different portions.

In FIG. 20, the CPU 10 judges whether the fixing electric power should be cut off, and when the fixing electric power should be cut off, the power source of the fixing apparatus is switched off.

Next, during standby, instructions for image formation are waited for, and when there are no instructions, advance is made to the process b of setting standby. The standby setting process b, if in FIG. 23, not first set to an initially set sheet size, operates the impedance varying means in the direction to prevent the temperature rise of the non-sheet passing portion in conformity with the initially set sheet width size.

Next, if the target temperature is not set at a standby temperature, the target temperature is set at the standby temperature equal to or lower than the temperature during image formation, and is inputted to the variable frequency power source.

Next, the maximum electric power allowed during the standby is inputted to the variable frequency power source.

Next, if during the standby, there are instructions for image formation, advance is made to process b in printing.

The process b in printing, if in FIG. 24, not first set to a designated sheet size, operates the impedance varying means in the direction to prevent the temperature rise of the non-sheet passing portion in conformity with the designate sheet width size.

Next, the target temperature is set at the temperature during image formation (the fixing temperature), and is inputted to the variable frequency power source. During printing, the electric power supply to the coil is controlled by the use of a "temperature-frequency " table corresponding to the then input impedance.

Next, the maximum electric power allowed during image formation is inputted to the variable frequency power source.

Next, if the temperature detected by the temperature detecting element 8 has reached the fixing temperature, an image forming condition flag is set, and shift is made to the image forming state.

If the detected temperature has not yet reached the fixing temperature, the standby condition is continued.

That is, when the fixing device rises to the standby temperature and a printing command is inputted in the standby condition, the input impedance of the excitation coil is varied in conformity with the designated sheet size by the impedance varying means, and the frequency of an electric current supplied from the alternating current source to the excitation coil is varied, whereby there is no excess electric power supply to the end portions in conformity with the sheet width size, and necessary minimum electric power supply can be effected. Also, during both standby and fixing, the temperature fluctuation of the fixing roller can be suppressed to a small level.

Others

1) The magnetic field generating means 4 may have at least the excitation coil 2.

2) The electromagnetic induction heat generating member can take-the form of a flexible endless or end-having film-like member (fixing film).

3) The electromagnetic induction heat generating member can be made into a fixed heater member, and use can be made of an apparatus construction in which a material to be heated is heated through heat-resistant film sliding in close contact with the heater member.

4) Of course, the heating apparatus of the present invention can be widely used not only as an image heating and fixing apparatus, but also as an image heating apparatus for heating, for example a recording material bearing an image thereon and improving the surface property thereof such as gloss, a heating apparatus for feeding a sheet-like article and drying, laminating, smoothing and heat-pressing it, a heating apparatus for drying used in an ink jet printer or the like, etc.

The present invention is not restricted to the above-described embodiments, but covers modifications identical in technical idea therewith.

What is claimed is:

1. An induction heating apparatus for heating an image formed on a recording material, comprising:

heating means for heating the image on the recording material, said heating means including a heating member and an excitation coil for generating a magnetic flux to induce an eddy current in said heating member;

an input impedance of said heating means being variable;

a temperature detecting element for detecting a temperature of said heating member; and control means for controlling a frequency of an electrical supply to said excitation coil so that the temperature detected by said temperature detecting element is maintained at a set temperature;

wherein said control means controls the frequency in accordance with the temperature detected by said temperature detecting element and information regarding the input impedance of said heating means.

2. An induction heating apparatus according to claim 1, wherein the input impedance of said heating means is varied by any change in the magnetic flux acting on said heating member.

3. An induction heating apparatus according to claim 2, wherein number of turns of said coil electrically energized can be changed, and the input impedance of said heating means is varied by the number of electrically energized turns of said coil.

4. An induction heating apparatus according to claim 2, wherein said heating means further includes a movable core for guiding the magnetic flux generated by said coil, and the input impedance of said heating means is varied by a position of said core.

5. An induction heating apparatus according to claim 2, wherein said heating means further includes a movable regulating member for regulating the magnetic flux acting on said heating member, and the input impedance of said heating means is varied by a position of said regulating member.

6. An induction heating apparatus according to claim 1, wherein the input impedance of said heating means is preset correspondingly to an operation of said apparatus.

7. An induction heating apparatus according to claim 1, wherein the input impedance of said heating means differs between a period until a temperature of said heating member rises to the set temperature and a period after the temperature of said heating member has risen to the set temperature.

8. An induction heating apparatus according to claim 1, wherein the input impedance of said heating means is preset correspondingly to a size of the recording material.

9. An induction heating apparatus according to claim 1, wherein said control means has a plurality of temperature-frequency tables corresponding to a plurality of input impedances of said heating means.

* * * * *

UNITED STATES PATENT AND TRADEMARK OFFICE

CERTIFICATE OF CORRECTION

PATENT NO. : 6,492,630 B2
DATED : December 10, 2002
INVENTOR(S) : Joji Nagahira

It is certified that error appears in the above-identified patent and that said Letters Patent is hereby corrected as shown below:

Drawings,
Figure 5, “INPEDANCE” (both occurrences) should read -- IMPEDANCE --.

Column 1,
Line 28, “electromagnetic.” should read -- electromagnetic --.

Column 3,
Line 53, “the-operations” should read -- the operations --.

Column 5,
Line 29, “gap a” should read -- gap α --.

Column 9,
Line 69, “moder” should read -- model --.

Column 10,
Line 4, “or” should read -- for --.
Line 19, “means.” should read -- means --.

Column 11,
Line 51, “gap a” should read -- gap α --.

Column 12,
Lines 6 and 9, “gap a” should read -- gap α --.

UNITED STATES PATENT AND TRADEMARK OFFICE

CERTIFICATE OF CORRECTION

PATENT NO. : 6,492,630 B2
DATED : December 10, 2002
INVENTOR(S) : Joji Nagahira

It is certified that error appears in the above-identified patent and that said Letters Patent is hereby corrected as shown below:

Column 14,
Line 62, “need” should read -- needs --.

Column 16,
Line 50, “take-the” should read -- take the --.

Signed and Sealed this

Nineteenth Day of August, 2003

JAMES E. ROGAN
*Director of the United States Patent and Trademark Office*